US011988462B2

(12) United States Patent
Agata et al.

(10) Patent No.: US 11,988,462 B2
(45) Date of Patent: May 21, 2024

(54) HEAT EXCHANGER AND AIR CONDITIONER USING THE HEAT EXCHANGER

(71) Applicant: Samsung Electronics Co., Ltd., Suwon-si (KR)

(72) Inventors: Yo Agata, Yokohama (JP); Hyunyoung Kim, Yokohama (JP); Kentaro Imagawa, Yokohama (JP); Takeshi Takahara, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/405,425

(22) Filed: Aug. 18, 2021

(65) Prior Publication Data

US 2022/0065556 A1 Mar. 3, 2022

(30) Foreign Application Priority Data

Aug. 31, 2020 (JP) ..... 2020-145949
May 26, 2021 (KR) ..... 10-2021-0067398

(51) Int. Cl.
*F28F 1/12* (2006.01)
*F25B 39/02* (2006.01)

(52) U.S. Cl.
CPC ..... *F28F 1/12* (2013.01); *F25B 39/02* (2013.01)

(58) Field of Classification Search
CPC .... F28F 1/12; F28F 1/126; F28F 1/105; F28F 13/04; F28F 17/005; F28F 2265/06; F25B 39/02
USPC ..... 165/181
See application file for complete search history.

(56) References Cited

U.S. PATENT DOCUMENTS 4,434,844 A * 3/1984 Sakitani ..... F28F 1/325 165/133
4,586,563 A 5/1986 Dubrovsky et al.
4,923,002 A 5/1990 Haussmann
(Continued)

FOREIGN PATENT DOCUMENTS

JP H08-189790 A 7/1996
JP 2001-201285 A 7/2001
(Continued)

OTHER PUBLICATIONS

International Search Report dated Dec. 16, 2021, issued in International Patent Application No. PCT/KR2021/010953.

*Primary Examiner* — Raheena R Malik
(74) *Attorney, Agent, or Firm* — Jefferson IP Law, LLP

(57) ABSTRACT

A heat exchanger is provided. The heat exchanger includes a configuration in which a heat transfer tube having a flat shape passes through a plurality of fins, and capable of securing drainage performance of condensed water retained on a surface of the heat transfer tube while improving a heat transfer rate, and further capable of suppressing an increase in ventilation resistance. The heat exchanger includes a heat transfer tube formed in a flat shape, and a plurality of fins, and a refrigerant flowing inside the heat transfer tube exchanges heat with air flowing between the plurality of fins. The fin includes a heat transfer expansion surface including a peak portion and a valley portion provided along an air flow direction, and a drain structure provided to overlap the heat transfer expansion surface.

18 Claims, 32 Drawing Sheets

(56) References Cited

U.S. PATENT DOCUMENTS 5,056,594 A * 10/1991 Kraay ..... F28F 1/325 165/181
5,975,200 A * 11/1999 Kato ..... F28F 1/325 165/181
8,613,307 B2 * 12/2013 Kim ..... F28F 17/005 165/181
8,973,647 B2 * 3/2015 Seo ..... F24F 13/30 165/181
10,557,652 B2 * 2/2020 Sato ..... F28F 1/04
2010/0018691 A1 * 1/2010 Ohgami ..... F28F 13/06 165/185
2010/0089557 A1 * 4/2010 Kim ..... F28F 17/005 165/182
2010/0175864 A1 * 7/2010 Fujino ..... F28F 1/325 165/182
2011/0030932 A1 * 2/2011 Tucker ..... F28F 1/32 29/890.047
2013/0087318 A1 * 4/2013 Nakano ..... F28F 1/126 165/181
2013/0153174 A1 * 6/2013 Taras ..... F28F 3/027 165/104.19
2014/0202674 A1 * 7/2014 Berta ..... F28F 17/005 165/181
2018/0120039 A1 * 5/2018 Nakamura ..... F28F 17/005
2019/0285321 A1 * 9/2019 Sato ..... F28F 17/005
2022/0065556 A1 * 3/2022 Agata ..... F28F 1/32
2022/0128319 A1 * 4/2022 Shimano ..... F28D 1/05366

FOREIGN PATENT DOCUMENTS

JP 2013-245884 A 12/2013
JP 2014-224638 A 12/2014
JP 2015-004449 A 1/2015
JP 2016-044895 A 4/2016
JP 2016-102593 A 6/2016
JP 6466631 B1 2/2019
JP 2019-215117 A 12/2019
KR 10-1313347 B1 10/2013
KR 10-2013-0120907 A 11/2013
KR 10-1572674 B1 11/2015
KR 10-2020-0037283 A 4/2020
WO WO2020/084786 A1 6/2021

* cited by examiner

HEAT EXCHANGER AND AIR CONDITIONER USING THE HEAT EXCHANGER

CROSS-REFERENCE TO RELATED APPLICATION(S)

This application is based on and claims priority under 35 U.S.C. § 119(a) of a Japanese patent application number 2020-145949, filed on Aug. 31, 2020, in the Japanese Intellectual Property Office, and of a Korean patent application number 10-2021-0067398, filed on May 26, 2021, in the Korean Intellectual Property Office, the disclosure of each of which is incorporated by reference herein in its entirety.

BACKGROUND

1. Field

The disclosure relates to a heat exchanger and an air conditioner using the heat exchanger.

2. Description of Related Art

Recently, in order to promote the efficiency of refrigerant conversion of air conditioners, a heat transfer tube of a heat exchanger has been thinner. For example, as disclosed in Patent Document 1, a flat tube member in which a number of holes is formed, that is a multi-bored flat tube, is used as a heat transfer tube.

However, when a heat exchanger of an outdoor unit operates as an evaporator during a heating operation, condensed water is generated on a heat transfer surface of the heat exchanger, and the condensed water is retained on the heat transfer tube. Therefore, when the above-mentioned flat tube is used as the heat transfer tube, water is easily retained on a surface (particularly, an upper surface) of the heat transfer tube and it is difficult for the retained water to be discharged and thus the drainage performance is deteriorated in comparison with a case of using a circular heat transfer tube. Therefore, an increase in the ventilation resistance and formation of frost may occur and it may cause deterioration of the performance of the outdoor unit.

Therefore, it is difficult to use a fin including a shape in which condensed water tends to be retained. For example, a fin including a cut surface such as a louver or a slit is expected to promote the heat transfer efficiency, but condensed water is easily retained on the cut surface, and thus it is difficult to use the fin having the cut surface. As described above, even if an attempt is made to improve the heat transfer efficiency through the study of the fin shape, there is a limitation in the fin shape in terms of the drainage of condensed water.

Within the restrictions of the shape of the fin, a shape, which is for the improvement of the heat transfer efficiency without providing a cut surface, may be exemplified by providing a peak portion and a valley portion along an air flow direction. In this configuration, a speed of air flowing along the fin is increased in the peak portion and the valley portion, so that a heat transfer rate is improved, and at the same time, a heat transfer area is increased. Therefore, it is possible to increase the amount of heat transfer, and furthermore, the drainage performance of the condensed water is excellent in comparison with the fin including the cut surface.

However, the fin including the peaks and valleys as described above have a narrower and longer air flow path than the flat fin, and thus the ventilation resistance is increased. When a change in a direction in which the air flows is large, the improvement of the heat transfer rate is large, but the increase in the ventilation resistance is also large. Therefore, when the direction in which the air flows is greatly changed, there is a risk that the performance of the outdoor unit is rather deteriorated.

The above information is presented as background information only to assist with an understanding of the disclosure. No determination has been made, and no assertion is made, as to whether any of the above might be applicable as prior art with regard to the disclosure.

RELATED ART DOCUMENT

[Patent Document 1] Japanese unexamined Patent Application Publication No. 2013-245884

SUMMARY

Aspects of the disclosure are to address at least the above-mentioned problems and/or disadvantages and to provide at least the advantages described below. Accordingly, an aspect of the disclosure is to provide a heat exchanger including a configuration, in which a heat transfer tube having a flat shape passes through a plurality of fins, and capable of securing drainage performance of condensed water retained on a surface of the heat transfer tube while improving a heat transfer rate, and further capable of suppressing an increase in ventilation resistance.

Additional aspects will be set forth in part in the description which follows and, in part, will be apparent from the description, or may be learned by practice of the presented embodiments.

In accordance with an aspect of the disclosure, a heat exchanger is provided. The heat exchanger includes a heat transfer tube formed in a flat shape, and a plurality of fins, and a refrigerant flowing inside the heat transfer tube exchanges heat with air flowing between the plurality of fins. Each fin of the plurality of fins includes a heat transfer expansion surface including a peak portion and a valley portion provided along an air flow direction, and a drain structure provided to overlap the heat transfer expansion surface.

With such a configuration, because the heat transfer expansion surface including the peak portion and the valley portion is provided, it is possible to improve a thermal conductivity and at the same time, because the drain structure is provided to overlap the heat transfer expansion surface, it is possible to improve the drainage performance of condensed water retained on a surface of the heat transfer tube. Further, by overlapping the drain structure on the heat transfer expansion surface with high air speed, it is possible to greatly disturb the air flow so as to increase the heat transfer rate while suppressing the increase in the ventilation resistance, in comparison with the case in which only the peak portion and the valley portion are provided. Specific data indicating a relationship between a change in the air flow direction and the improvement of the heat transfer rate and the increase in the ventilation resistance will be described later.

It is appropriate that the drain structure is a concave-convex shape formed in the heat transfer expansion surface.

With such a configuration, it is possible to allow condensed water retained on the surface of the heat transfer tube to flow along the concave-convex shape, and thus the drainage performance may be sufficiently exhibited.

As a more specific embodiment of the drain structure, dimples or beads formed on the heat transfer expansion surface may be exemplified.

It is appropriate that the plurality of heat transfer tubes is arranged in multiple stages in a vertical direction to allow a flat surface to face up and down, the fin is formed in a long shape extending in the vertical direction, and at the same time, through which the plurality of heat transfer tubes passes, on one long side of the fin, a cutting groove is formed at a position corresponding to the plurality of heat transfer tubes, the other long side of the fin extends in a straight line from an upper end to a lower end, and the drain structure is provided to drain water droplets, which are generated on a surface of the heat transfer tube, toward the other long side.

With such a configuration, water droplets discharged by the drain structure may flow down the long side extending in a straight line of the fin, and it is difficult to collect water droplets in the cutting groove and thus it is possible to improve the drainage performance of the condensed water.

However, in response to that the heat transfer expansion surface including the peak portion and the valley portion overlaps the drain structure, a material of the overlapping portions is elongated to be thinner in the peak portion and concentrated to be thicker in the valley portion, and thus the fin may be easily ruptured or damaged in the peak portion or the valley portion.

Therefore, in consideration of the workability of the fin, it is appropriate that a height of an overlapping portion in the peak portion of the drain structure is less than a height of an overlapping portion in the valley portion.

With such a configuration, it may be possible to relieve the elongation of the material during processing of the overlapping portion in the peak portion of the drain structure, and at the same time, it may be possible to relieve the concentration of material in the overlapping portion in the valley portion of the drain structure, thereby preventing cracks or damage.

The fin may be a corrugated fin in which the peak portion and the valley portion are alternately formed, and it is appropriate that a corrugated angle is greater than or equal to 5°, but is less than or equal to 24°.

In this case, the increase in the ventilation resistance may be suppressed, and the improvement of drainage performance and the improvement of heat exchanger performance may be compatible. Specific data will be described later.

Further, the heat exchanger disclosed in Patent Document 1 described in the related art is configured to drain condensed water by moving condensed water to fins, through which heat transfer tubes provided in multiple stages pass, in order to improve the drainage performance of water retained on the surface of the flat tube.

However, although it tries to move condensed water from the fin, when two or more rows of heat transfer tubes arranged in multiple stages are provided, condensed water may be moved to the next heat transfer tube and then retained without being drained, and thus it may be difficult to sufficiently improve the drainage performance.

Accordingly, the disclosure has been made to ease the above difficulties, particularly, in a heat exchanger in which two or more rows of heat transfer tubes having a flat shape are arranged, the drainage performance of condensed water retained on the surface of the heat transfer tube may be improved.

The heat exchanger may include a first heat exchange portion, in which the plurality of first heat transfer tubes, which is formed in a flat shape and provided in multiple stages, passes through the plurality of first fins, and a second heat exchange portion, in which the plurality of second heat transfer tubes, which is formed in a flat shape and provided in multiple stages, passes through the plurality of second fins. In the heat exchanger in which the first heat exchange portion and the second heat exchange portion are arranged adjacent to each other in a width direction of the heat transfer tube, a distance between the first heat transfer tube and the second heat transfer tube adjacent to each other may be greater than 40% of a width dimension of the first heat transfer tube or the second heat transfer tube, and a distance between the first fin and the second heat transfer tube may be greater than 20% of a width dimension of the second fin.

In the heat exchanger with such a configuration, because the distance between the first heat transfer tube and the second heat transfer tube or the distance between the first fin and the second heat transfer tubes is great, condensed water may flow through the space therebetween, thereby improving the drainage performance in comparison with the related art. Specific data will be described later.

As an embodiment for sufficiently increasing the distance between the first heat transfer tube and the second heat transfer tube, a configuration in which the first heat transfer tube is disposed on one side in the width direction rather than a center of the first fin in the width direction, the second heat transfer tube is disposed on the other side in the width direction rather than a center of the second fin in the width direction, and the other side of the first fin in the width direction and the one side of the second fin in the width direction are interposed between the first heat transfer tube and the second heat transfer tube, may be exemplified.

Particularly, it is appropriate that the first fin is provided in such a way that a cutting groove, to which the first heat transfer tube is inserted, is formed on one side thereof in the width direction, and the other side thereof is continuously provided along a longitudinal direction, and the second fin is provided in such a way that one side thereof is continuously provided along a longitudinal direction and a cutting groove, to which the second heat transfer tube is inserted, is formed on the other side thereof in the width direction.

With such a configuration, condensed water may flow down through portions continuously formed in the longitudinal direction in the first fin and the second fin.

As another embodiment for sufficiently increasing the distance between the first heat transfer tube and the second heat transfer tube, a configuration, in which both ends of the first heat transfer tube in the width direction are positioned inward than both ends of the first fin in the width direction, and both ends of the second heat transfer tube in the width direction are positioned inward than both ends of the second fin in the width direction, may be exemplified.

As another example, the first heat transfer tube and the second heat transfer tube may be arranged in a zigzag shape along a longitudinal direction perpendicular to the width direction.

In order to improve heat exchange efficiency, the first heat transfer tube or the second heat transfer tube may be provided in a plurality of rows with respect to the first fin or the second fin.

As mentioned above, the heat exchanger disclosed in Patent Document 1 described in the related art is configured to drain condensed water by moving condensed water to fins, through which heat transfer tubes provided in multiple stages pass, in an attempt to improve the drainage performance of water retained on the surface of the flat tube.

However, although Patent Document 1 tries to move condensed water along the fin, a pitch of the plurality of fins (hereinafter referred to as a fin pitch) is too small and a bridge of condensed water may be easily formed between adjacent fins. Thus it is difficult to obtain sufficient drainage performance. However, in response to the fin pitch being too large, it is difficult to secure heat exchange efficiency. In addition, in response to a width dimension of the heat transfer tube being too large, an amount of condensed water retained on the heat transfer tube may be increased accordingly. Thus it is difficult to obtain sufficient drainage performance, and in response to that a width dimension of the heat transfer tube being too small, it is difficult to secure the heat exchange efficiency.

Accordingly, the disclosure has been made to ease the above difficulties, particularly, in the heat exchanger in which the heat transfer tubes having a flat shape passes through the plurality of fins, it is intended to secure the heat exchange efficiency while improving the drainage performance of condensed water retained on the surface of the heat transfer tube in comparison with the related art.

That is, in the heat exchanger according to the disclosure, the heat transfer tube formed in a flat shape may pass through the plurality of fins arranged at a predetermined fin pitch, and a width dimension of the heat transfer tube may be greater than or equal to 4 times, but is less than or equal to 7 times of the fin pitch.

In the heat exchanger with such a configuration, because the width dimension of the heat transfer tube is greater than or equal to 4 times, but is less than or equal to 7 times of the fin pitch, it may be possible to secure the heat exchange efficiency (fin efficiency) and to suppresses the deterioration of the drainage performance, thereby improving the drainage performance in comparison with the related art. Specific data will be described later.

Particularly, a configuration in which a width dimension of at least a portion of the heat transfer tube is less than or equal to 10 mm, may be exemplified.

In accordance with another aspect of the disclosure, an air conditioner is provided. The air conditioner includes the above-described heat exchanger, and the above-described operation and effect may be exhibited even by such an air conditioner.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

First Embodiment

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In an air conditioner including a refrigerant circuit to which a compressor, an outdoor heat exchanger, an expansion mechanism, and an indoor heat exchanger are connected, a heat exchanger 100 according to an embodiment is used in at least one side of the outdoor heat exchanger or the indoor heat exchanger.

Figure 1:
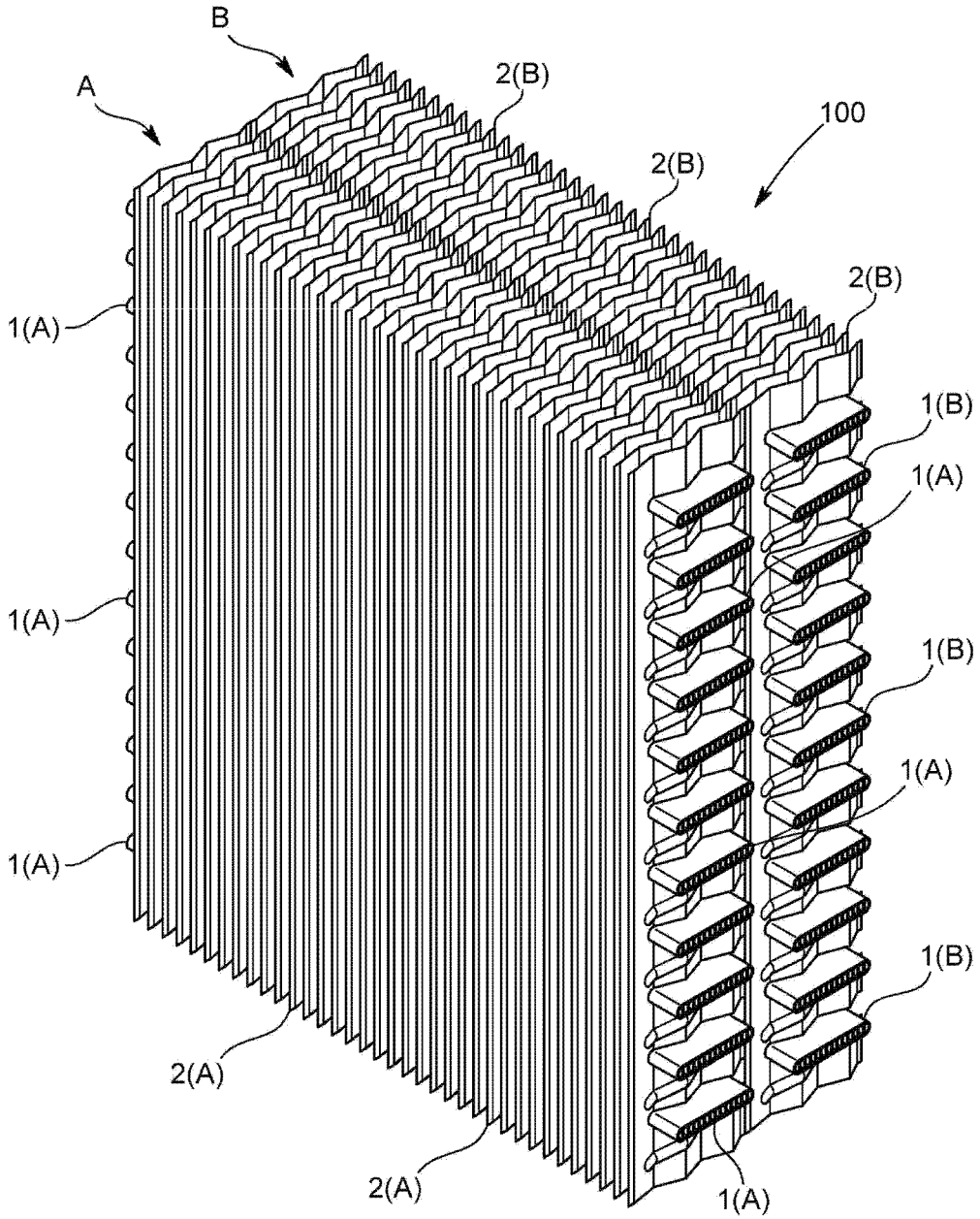
FIG. 1 is a schematic view illustrating an overall configuration of a heat exchanger according to an embodiment of the disclosure.

FIG. 1 is a schematic view illustrating an overall configuration of a heat exchanger according to an embodiment of the disclosure.

Referring to FIG. 1, the heat exchanger 100 is a type of fin-and-tube heat exchanger, and is provided with a plurality of heat transfer tubes 1 through which refrigerant flows, and a plurality of fins 2 provided in the heat transfer tubes 1.

The heat transfer tube 1 is a type of multi-bored flat tube formed in a flat shape and including a plurality of flow path in which refrigerant flows. The heat transfer tube 1 according to the embodiment is arranged in such a way that a flat surface faces up and down, that is, the flat surface becomes horizontal, so as to allow the refrigerant to flow therein in a horizontal direction.

The heat transfer tubes 1 are arranged in multiple stages in a vertical direction, for example, parallel to each other at regular intervals. In the embodiment, a row composed of a plurality of first heat transfer tubes 1A, and a row composed of a plurality of second heat transfer tubes 1B adjacent in a width direction are provided. Particularly, the first heat transfer tube 1A and the second heat transfer tube 1B adjacent to each other are arranged to have the same height as each other. The heat transfer tube is not limited to two rows but may be three or more rows, or may be a single row.

The fins 2 are formed in a long bar shape extending in the vertical direction, and through which the plurality of heat transfer tubes 1 formed in multiple stages passes. The fins 2 are arranged at a predetermined fin pitch along an extending direction of the heat transfer tube 1, and arranged at regular intervals. Accordingly, heat exchange is performed between air, which flows between the fins 2 along the width direction of the fin 2, and the refrigerant flowing through an internal flow path of the heat transfer tube 1.

The plurality of fins 2 arranged along the extending direction of the heat transfer tube 1 is provided, for example, in two or more rows, similar to the number of rows of the transfer tube 1. In this case, a row composed of a plurality of first fins 2A through which the first heat transfer tube 1A passes, and a row composed of a plurality of the second fins 2B through which the second heat transfer tube 1B passes are provided. At this time, the fins 2 are not limited to two rows, but may be provided in three or more rows or may be in a single row.

With the above configuration, the heat exchanger X according to the embodiment includes a first heat exchange portion A in which the plurality of first heat transfer tubes 1A provided in multiple stages passes through the plurality of first fins 2A and a second heat exchange portion B in which the plurality of second heat transfer tubes 1B provided in multiple stages passes through the plurality of second fins 2B. The first heat exchange portion A and the second heat exchange portion B are arranged adjacent to each other in the width direction of the heat transfer tubes 1A and 1B.

At this time, the first heat transfer tube 1A and the second heat transfer tube 1B are the same size as each other, and unless the first heat transfer tube 1A and the second heat transfer tube 1B are not distinguished below, the heat transfer tubes 1A and 1B are collectively referred to as a heat transfer tube 1. In addition, the first fin 2A and the second fin 2B are the same size as each other, and unless the first fin 2A and the second fin 2B are not distinguished below, the fins 2A and 2B are collectively referred to as a fin 2.

Figure 2:
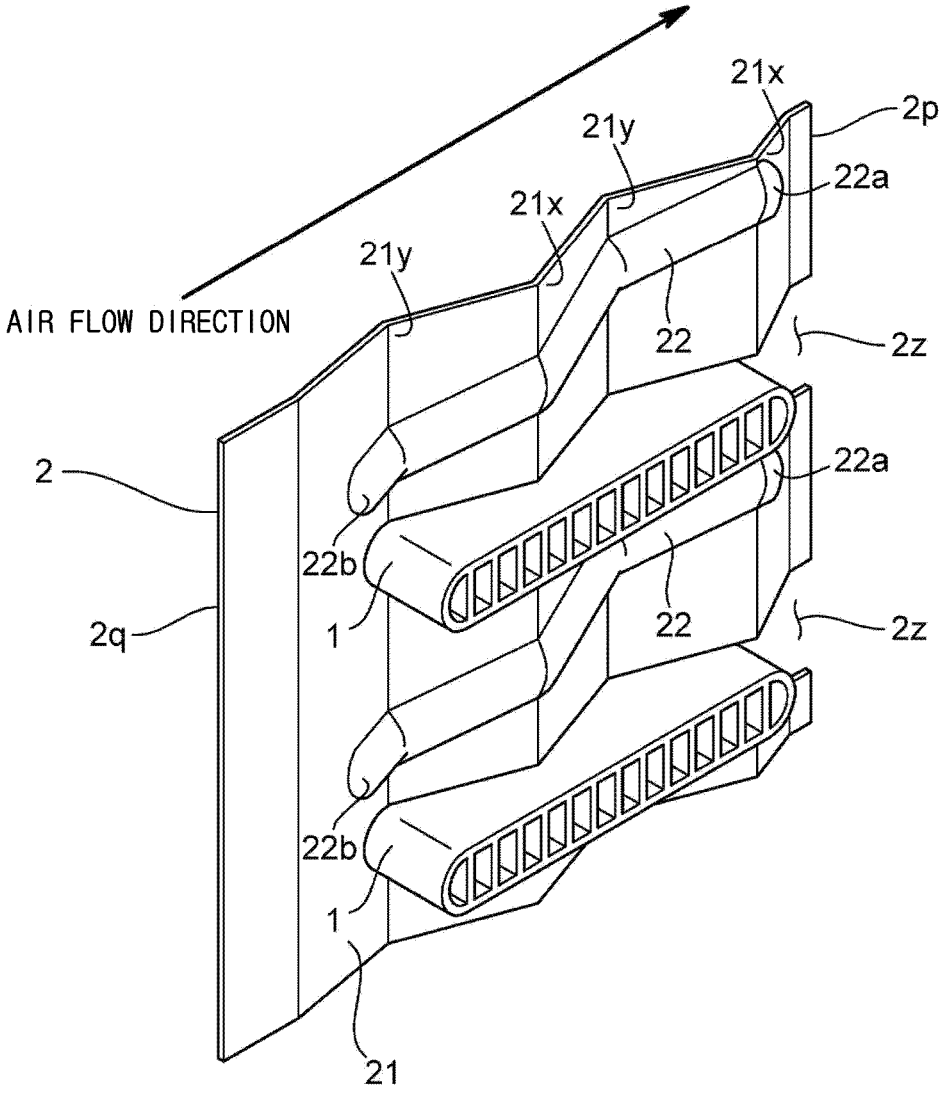
FIG. 2 is a schematic view illustrating a configuration of a drain structure according to an embodiment of the disclosure.

FIG. 2 is a schematic view illustrating a configuration of a drain structure according to an embodiment of the disclosure.

Referring to FIG. 2, the fin 2 according to the embodiment includes a heat transfer expansion surface 21 including a peak portion 21$x$ and a valley portion 21$y$ formed in the air flow direction, that is the width direction of the fin 2, and a drain structure 22 provided to overlap the heat transfer expansion surface 21.

First, the heat transfer expansion surface 21 will be described.

The heat transfer expansion surface 21 is formed by processing the fin 2 having the flat shape, and provided to expand a heat transfer area of the fin 2.

The heat transfer expansion surface 21 includes the peak portion 21$x$ formed by folding the flat fin 2 convexly and the valley portion 21$y$ by folding the fin 2 concavely. The peak portion 21$x$ and the valley portion 21$y$ are formed as a corrugated portion extending along a longitudinal direction (vertical direction) of the fin 2.

Figure 3:
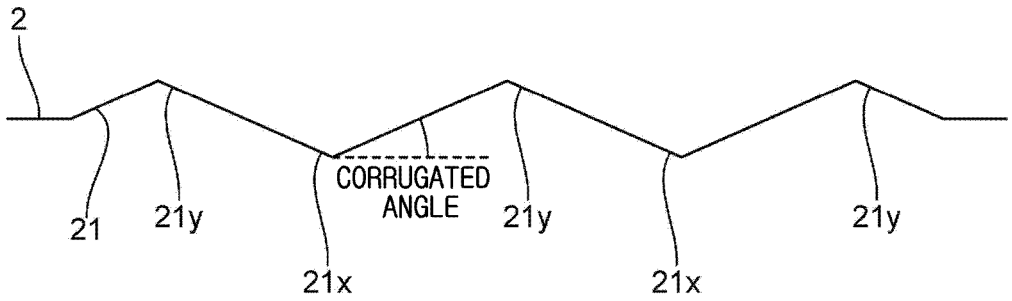
FIG. 3 is a schematic view illustrating an angle of a corrugated fin according to an embodiment of the disclosure.

FIG. 3 is a schematic view illustrating an angle of a corrugated fin according to an embodiment of the disclosure.

Referring to FIG. 3, the fin 2 according to the embodiment is a corrugated fin in which a corrugation processing is performed. A corrugated angle, which is an angle at which the fin 2 is folded during the corrugation processing, is set to be greater than or equal to 5°, but be less than or equal to 24° and the fin 2 is formed by alternately repeating the peak portion 21$x$ and the valley portion 21$y$, which are formed at the corrugated angle, in the width direction of the fin 2.

Next, the drain structure 22 will be described.

The drain structure 22 is provided to discharge condensed water, which is generated when the heat exchanger 100 of the outdoor unit is operated as a condenser during a heating operation, from a surface of the heat transfer tube 1 or a surface of the fin 2. Particularly, the drain structure 22 is provided to prevent condensed water from being retained on the flat surface of the heat transfer tube 1.

Particularly, the drain structure 22 is a concave portion in which the surface of the fin 2 is recessed from the peak portion 21*x* to the valley portion 21*y* or a convex portion in which the surface of the fin 2 is convexly expanded from the valley portion 21*y* to the peak portion 21*x*. In the embodiment, as illustrated in FIG. 2, the drain structure 22 is a protrusion having a bead shape or a rib shape elongated in the width direction of the fin, and a surface of the protrusion of the drain structure 22 is a curved surface protruding from the valley portion 21*y* side to the peak portion 21*x* side.

The drain structure 22 is provided to overlap the heat transfer expansion surface 21. Particularly, the drain structure 22 overlaps at least one of the corrugated portions formed as the peak portion 21*x* or the valley portion 21*y*, and in the embodiment, the drain structure 22 is formed over a plurality of peak portions 21*x* and valley portions 21*y* adjacent to each other.

In the embodiment, as described above, the plurality of heat transfer tubes 1 is arranged in multiple stages in the vertical direction to allow a flat surface to face up and down, and the fin 2 is formed in a long bar shape extending in the vertical direction, and through which the plurality of heat transfer tubes 1 passes. As illustrated in FIG. 2, on one long side 2*p* of the fin 2, a cutting groove 2*z* is formed at a position corresponding to the plurality of heat transfer tubes 1. Therefore, the heat transfer tube 1 is inserted to the fin 2 through the cutting groove 2*z*. On the other hand, the cutting groove is not provided on the other long side 2*q* of the fin 2 and thus the other long side 2*q* extends in the straight line from an upper end to a lower end.

In this configuration, the drain structure 22 according to the embodiment is provided to discharge the condensed water, which is generated when the heat exchanger 100 is operated as a condenser, toward the other long side 2*q* of the fin 2.

Particularly, as illustrated in FIG. 2, the protrusion of the drain structure 22 having an elongated shape corresponding to the drain structure 22 is formed in such a way that one end portion 22*a*, which is located on the one long side 2*p* of the fin, is positioned higher than the other end portion 22*b*, which is located on the other long side 2*q* of the fin 2, and the one end portion 22*a* is inclined downward to the other end portion 22*b*. Accordingly, the condensed water flows to the other long side 2*q* side of the fin 2 along the protrusion of the drain structure 22, and then flows down along the other long side 2*q*.

The fin 2 according to the embodiment includes the plurality of protrusions 22 as the drain structure. Particularly, at least one protrusion of the drain structure 22 is provided between the plurality of heat transfer tubes 1 provided in multiple stages in the vertical direction, respectively.

Figure 4:
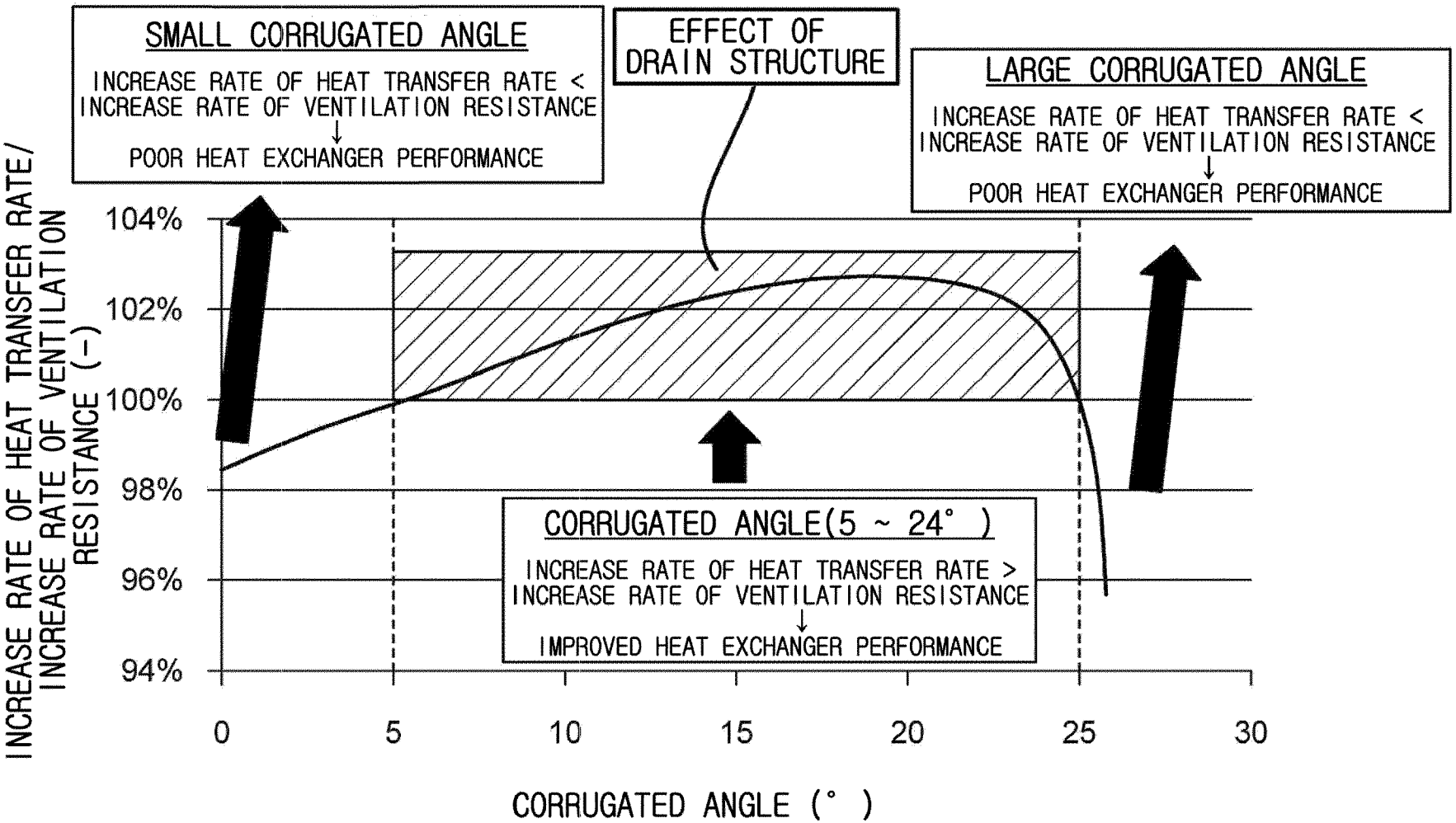
FIG. 4 is a graph illustrating an effect of the drain structure according to an embodiment of the disclosure.

Next, experimental data of an operation effect by the above-described configuration is illustrated in a graph of FIG. 4.

FIG. 4 is a graph illustrating an effect of the drain structure according to an embodiment of the disclosure.

Referring to FIG. 4, in the graph, a horizontal axis indicates the corrugated angle of the fin 2, and a vertical axis indicates a ratio of an increase rate of a heat transfer rate to an increase rate of a ventilation resistance (hereinafter referred to as a heat exchanger performance index). On the vertical axis, the heat exchanger performance index is 100% in a case in which the protrusion of the drain structure 22 is not provided in the fin 2 in each corrugated angle.

In a case that the drain structure is provided in the flat fin in which the corrugation process is not performed, the increase rate of the ventilation resistance becomes larger than the increase rate of the heat transfer rate by the drain structure. Accordingly, the drainage performance is improved, but the performance of the heat exchanger is deteriorated. As evidence thereof is a case in which the corrugated angle is 0 degrees in the graph of FIG. 4, and it can be seen that the heat exchanger performance index is less than 100%.

On the other hand, as shown by a curve in the graph of FIG. 4, by forming a corrugated angle of greater than or equal to 5°, but less than or equal to 24° while providing the drain structure 22 on the fin 2, the heat exchanger performance index is greater than 100% and thus it can be seen that the improvement of drainage performance and the improvement of heat exchanger performance may be compatible.

Particularly, in a case that the drain structure 22 overlaps a region in which the air flow direction is changed by the corrugation process, that is a region in which the peak portion 21*x* and the valley portion 21*y* are formed by the corrugation process, the increase rate of the heat transfer rate and the increase rate of ventilation resistance are changed in accordance with the air flow direction (corrugated angle).

Therefore, as described above, by setting the corrugated angle of greater than or equal to 5°, but less than or equal to 24°, the increase rate of the heat transfer rate is higher than the increase rate of the ventilation resistance, and thus it is possible to obtain the heat exchanger performance index exceeding 100%.

In the heat exchanger 100 including the above-mentioned configuration, because the fin 2 is provided with the heat transfer expansion surface 21 including the peak portion 21*x* and the valley portion 21*y*, it is possible to improve the thermal conductivity, and further because the drain structure 22 is provided to overlap the heat transfer expansion surface 21, it is possible to improve the drainage performance of condensed water that is retained on the surface of the heat transfer tube 1. Further, because the corrugated angle is set to be greater than or equal to 5°, but be less than or equal to 24°, it is possible to greatly disturb the air flow so as to increase the heat transfer rate while suppressing the increase in the ventilation resistance, in comparison with the case in which only the peak portion 21*x* and the valley portion 21*y* are provided. Accordingly, the improvement of drainage performance and the improvement of heat exchanger performance may be compatible.

In addition, in the configuration in which the cutting groove 2*z* is provided in the one long side 2*p* of the fin 2 and the other long side 2*q* extends in the straight line, the protrusion corresponding to the drain structure 22 is provided to drain water droplets, which are generated on the surface of the heat transfer tube 1, toward the other long side 2*q* and thus the water droplets flows down along the other long side 2*q* and the water droplets is prevented from being retained in the cutting groove 2*z* of the one long side 2*p*. Therefore, it is possible to more improve the drainage performance of the condensed water.

Modification of the First Embodiment

The disclosure is not limited to the first embodiment.

Figure 5:
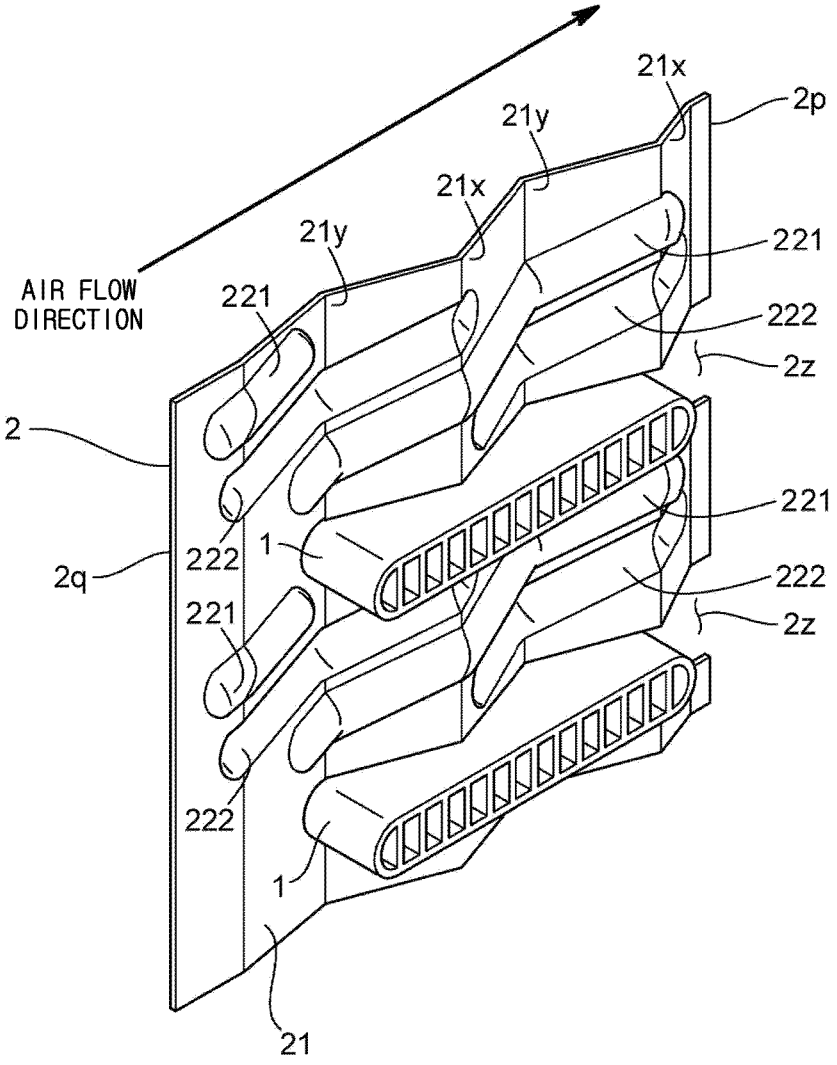
FIG. 5 is a schematic view illustrating a configuration of a drain structure according to an embodiment of the disclosure.

FIG. 5 is a schematic view illustrating a configuration of a drain structure according to an embodiment of the disclosure.

For example, in the first embodiment, one drain structure (221, 222) is provided between the heat transfer tubes 1 adjacent to each other in the vertical direction, but referring to FIG. 5, a plurality of drain structures (221, 222) may be provided between the heat transfer tubes 1. According to the embodiment, the plurality of protrusions of the drain structures (221, 222) inclined from the one long side 2*p* to the other long side 2*q* of the fin is formed as the drain structure in the same manner as in the first embodiment, but the protrusions of the drain structures (221, 222) have different lengths and/or a protruding direction of the protrusions of the drain structures (221, 222) is opposite to each other.

Figure 6:
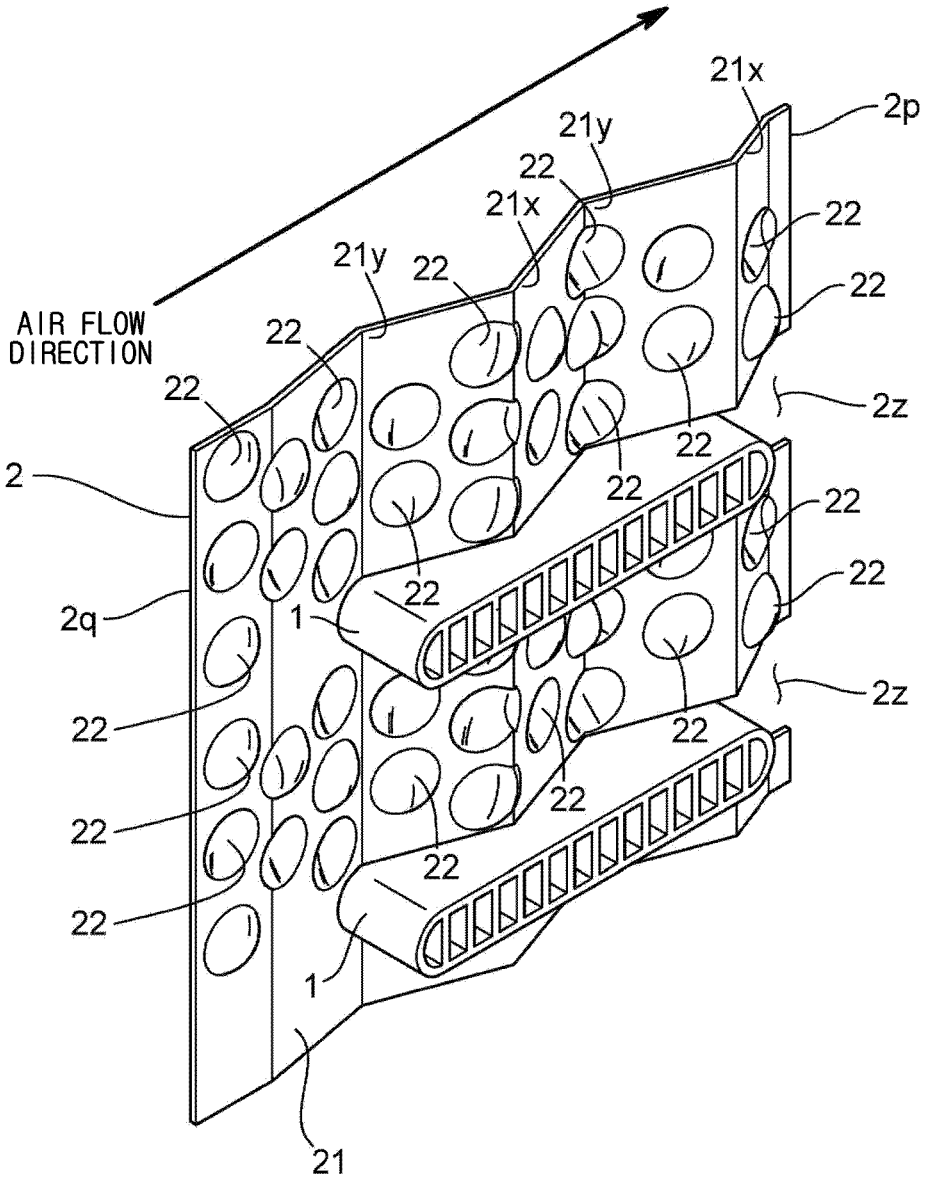
FIG. 6 is a schematic view illustrating a configuration of a drain structure according to an embodiment of the disclosure.

FIG. 6 is a schematic view illustrating a configuration of a drain structure according to an embodiment of the disclosure.

In addition, the drain structure 22 is the protrusion having the bead shape or the rib shape according to the above embodiment, but the drain structure 22 may be a concave portion or a convex portion formed by a dimple processing, referring to FIG. 6. In the embodiment, the drain structure 22 includes a concave portion or a convex portion which are formed in a hemispherical shape, but it may be a cylindrical shape or a conical shape.

Figure 7:
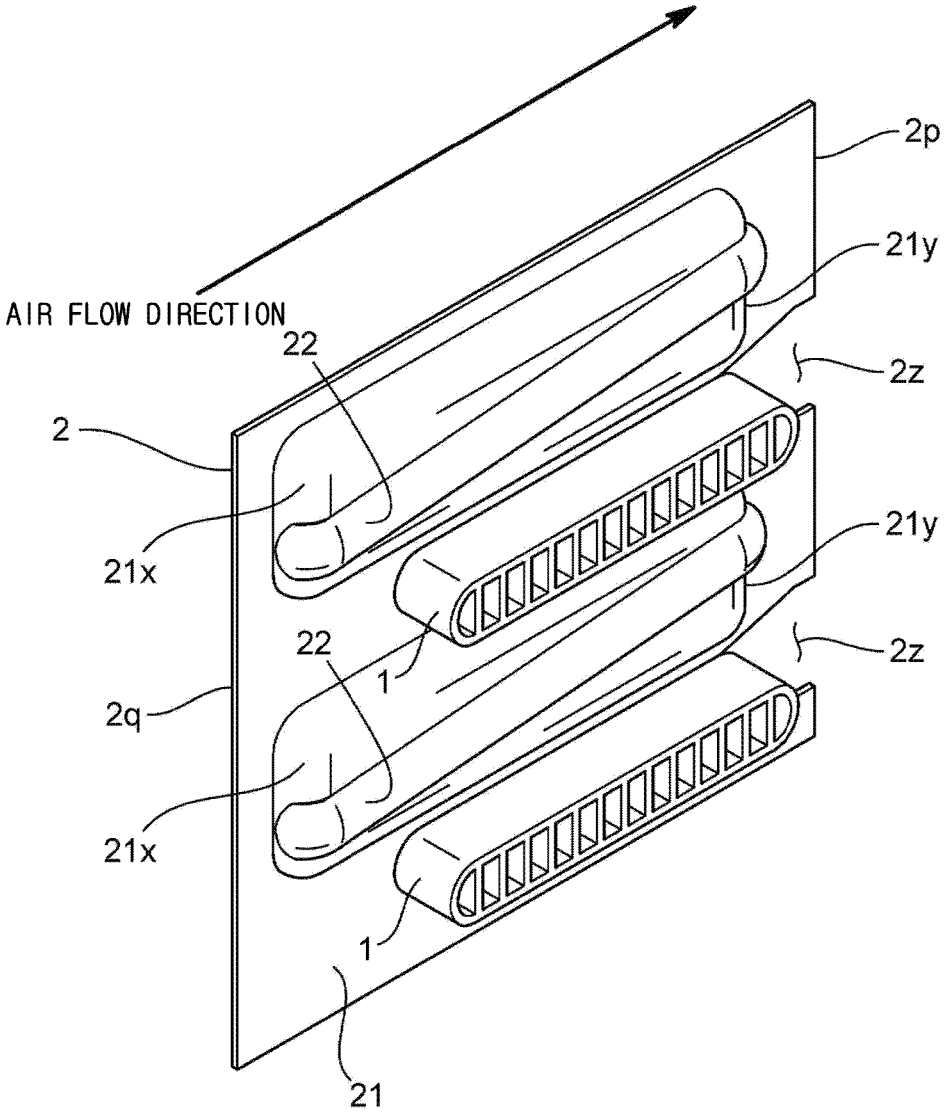
FIG. 7 is a schematic view illustrating a configuration of a peak portion and a valley portion according to an embodiment of the disclosure.

FIG. 7 is a schematic view illustrating a configuration of a peak portion and a valley portion according to an embodiment of the disclosure.

In addition, in the above embodiment, the case in which the peak portion 21*x* and the valley portion 21*y* are formed by the corrugation process has been described, but referring to FIG. 7, the peak portion 21*x* and the valley portion 21*y* may be formed by the drawing processing. That is, the peak portion 21*x* may be a portion in which the surface of the fin 2 protrudes in the air flow direction, and the valley portion 21*y* may be a portion in which the surface of the fin 2 is recessed in the air flow direction, but the shape thereof may vary.

Figure 8:
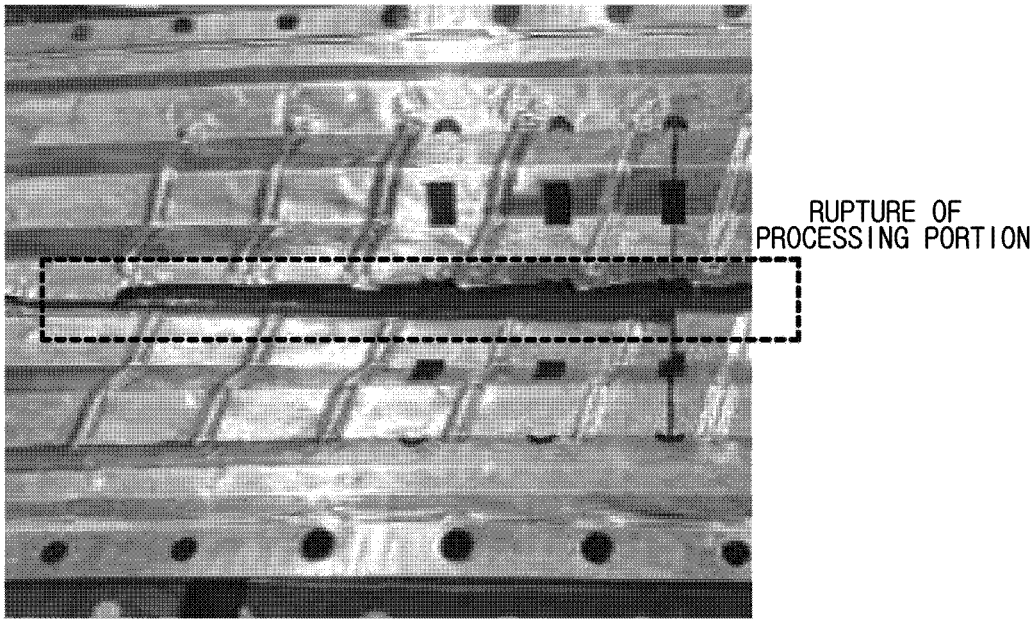
FIG. 8 is a photograph illustrating a portion, in which the peak portion and the valley portion are processed, is ruptured according to an embodiment of the disclosure.

FIG. 8 is a photograph illustrating a portion, in which the peak portion and the valley portion are processed, is ruptured according to an embodiment of the disclosure.

However, in response to that the heat transfer expansion surface 21 including the peak portion 21*x* and the valley portion 21*y* overlaps the drain structure 22, a material of the overlapping portions is thinner in the peak portion 21*x* and a material of the overlapping portions is concentrated in the valley portion 21*y*, and thus the fin 2 is easily ruptured or damaged at the peak portion 21*x* or the valley portion 21*y* (refer to FIG. 8).

Figure 9:
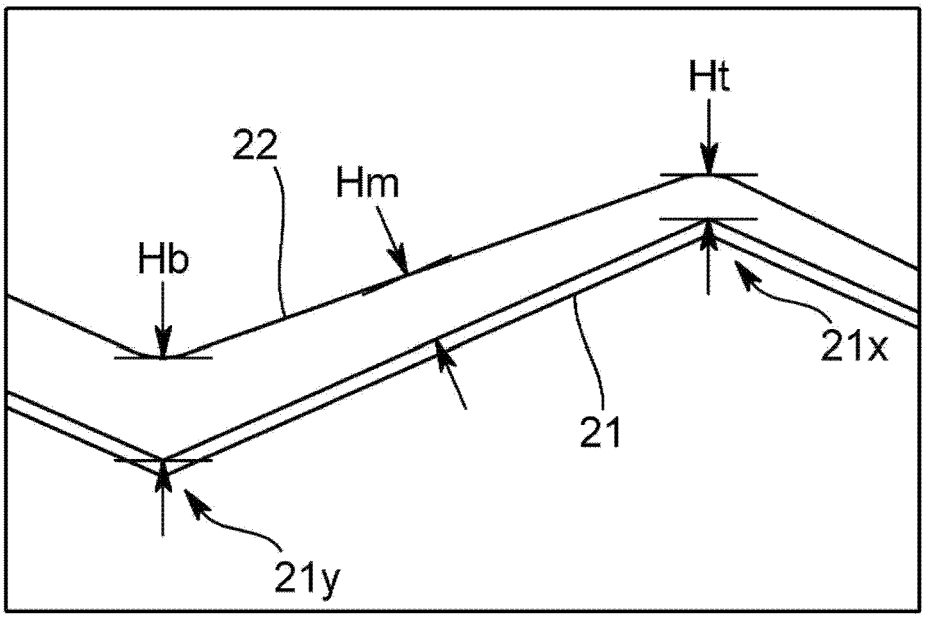
FIG. 9 is a schematic view illustrating a configuration of a drain structure according to an embodiment of the disclosure.

FIG. 9 is a schematic view illustrating a configuration of a drain structure according to an embodiment of the disclosure.

Therefore, in consideration of the workability of the fin 2, referring to FIG. 9, a height of the overlapping portion in the peak portion 21*x* of the drain structure 22 may be less than a height of the overlapping portion in the valley portion 21*y*. The 'height' represents a distance from a portion of the surface of the fin 2, in which the drain structure 22 is not provided, to a surface of the drain structure 22.

Particularly, referring to FIG. 9, when it is assumed that a height of the overlapping portion at the peak portion 21*x* of the drain structure 22 is Ht, a height of the overlapping portion at the valley portion 21*y* is Hb, and a height of a central portion between the peak portion 21*x* and the valley portion 21*y* is Hm, a formular Hb>Hm>Ht is satisfied.

Figure 10:
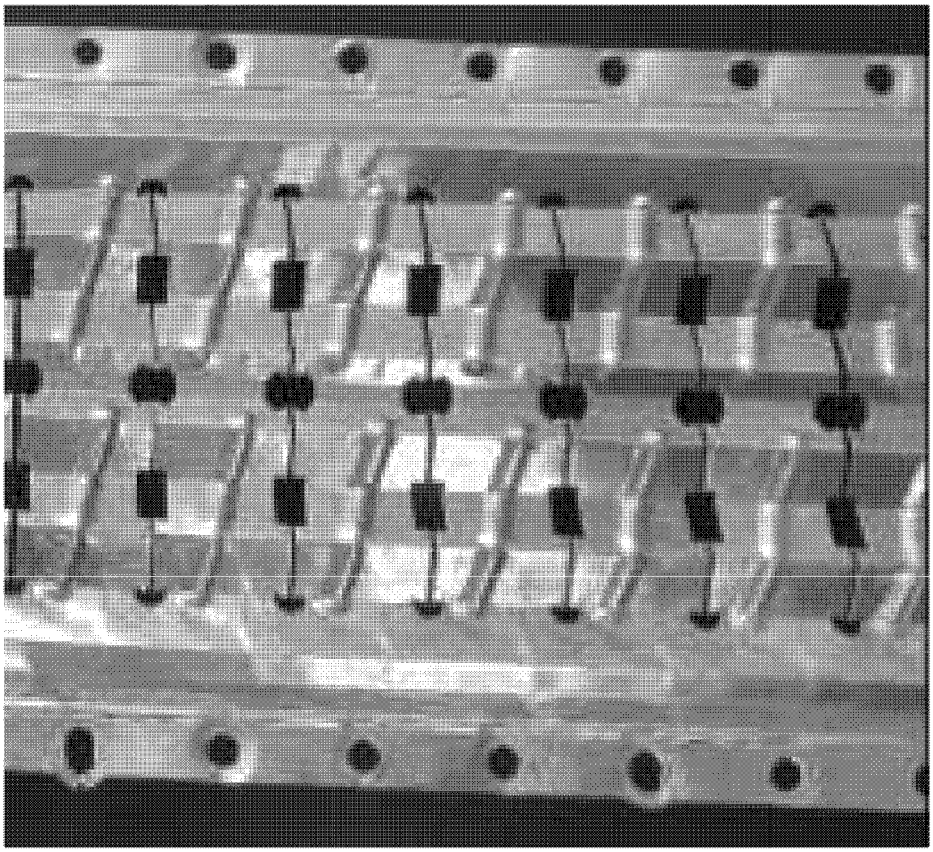
FIG. 10 is a photograph illustrating an effect of the drain structure according to an embodiment of the disclosure.

FIG. 10 is a photograph illustrating an effect of the drain structure according to an embodiment of the disclosure.

With such a configuration, elongation of the material may be relieved during processing of the overlapping portion at the peak portion 21*x* of the drain structure 22, and thus the concentration of material may be relieved in the overlapping portion at the valley portion 21*y* of the drain structure 22 and at the same time, the rupture or breakage may be prevented (refer to FIG. 10).

Figure 11:
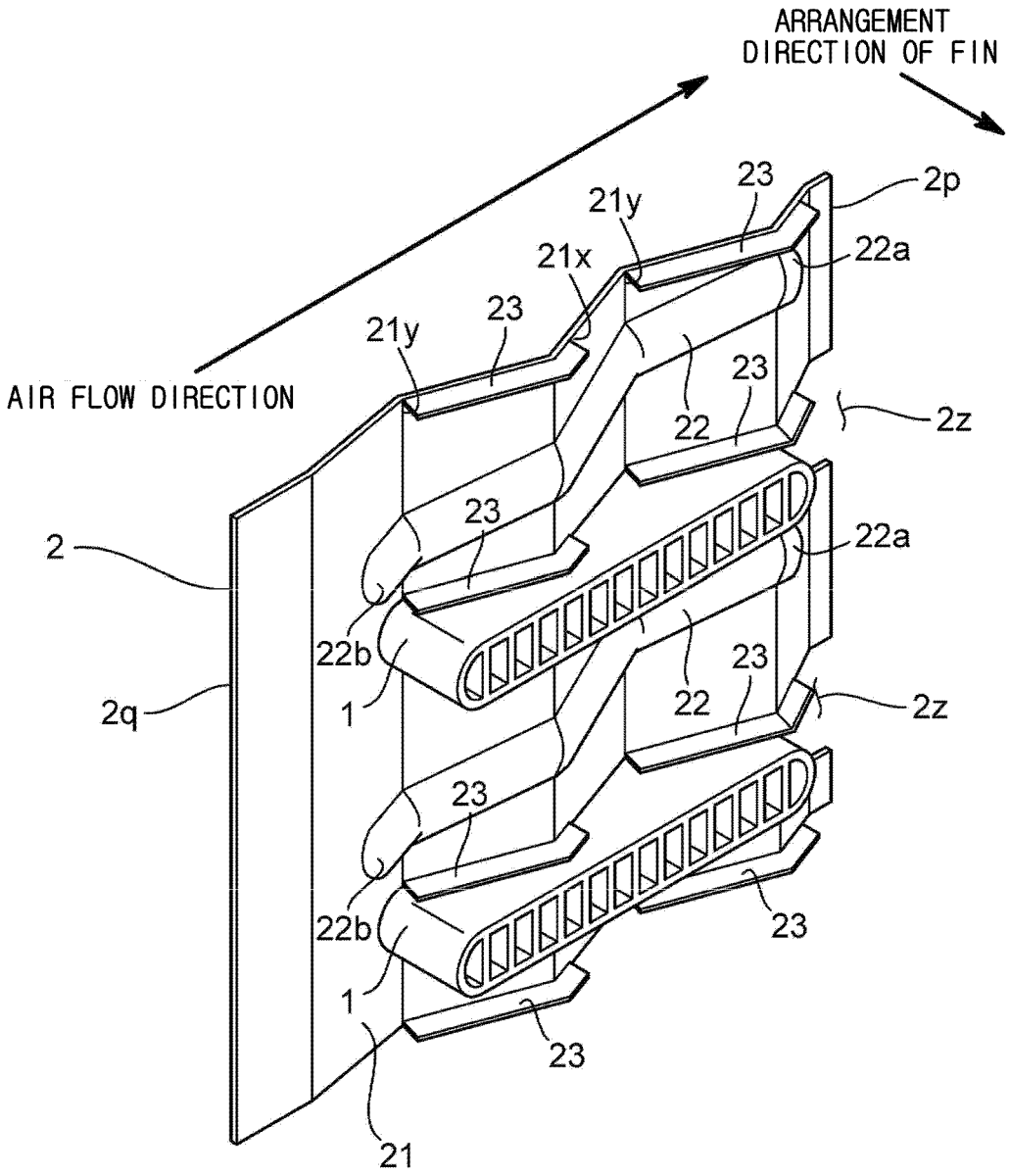
FIG. 11 is a schematic view illustrating an intermediate configuration of a fin that is considered for assembly of a heat transfer tube according to an embodiment of the disclosure.

FIG. 11 is a schematic view illustrating an intermediate configuration of a fin that is considered for assembly of a heat transfer tube according to an embodiment of the disclosure.

As a configuration of the fin 2 for improving the heat exchange efficiency between the fin 2 and the heat transfer tube 1 inserted into the cutting groove 2*z* of the fin 2, an intermediate configuration including a contact surface 23, which is formed by bending an inner peripheral surface of the cutting groove 2*z* toward an arrangement direction of the fin, referring to FIG. 11, is studied.

With such a configuration, because a contact area between the contact surface 23 and an outer peripheral surface of the heat transfer tube 1 is increased, the heat exchange efficiency may be improved.

However, in a state in which the contact surface 23 is provided on the fin 2 including the peak portion 21*x* and the valley portion 21*y*, when the heat transfer tube 1 is inserted into the cutting groove 2*z*, stress may be concentrated at an end portion of an inner side (an inner side of an insertion direction of the heat transfer tube 1) of the contact surface 23 and it may cause a risk in which the fin 2 is bent or broken therein.

Figure 12:
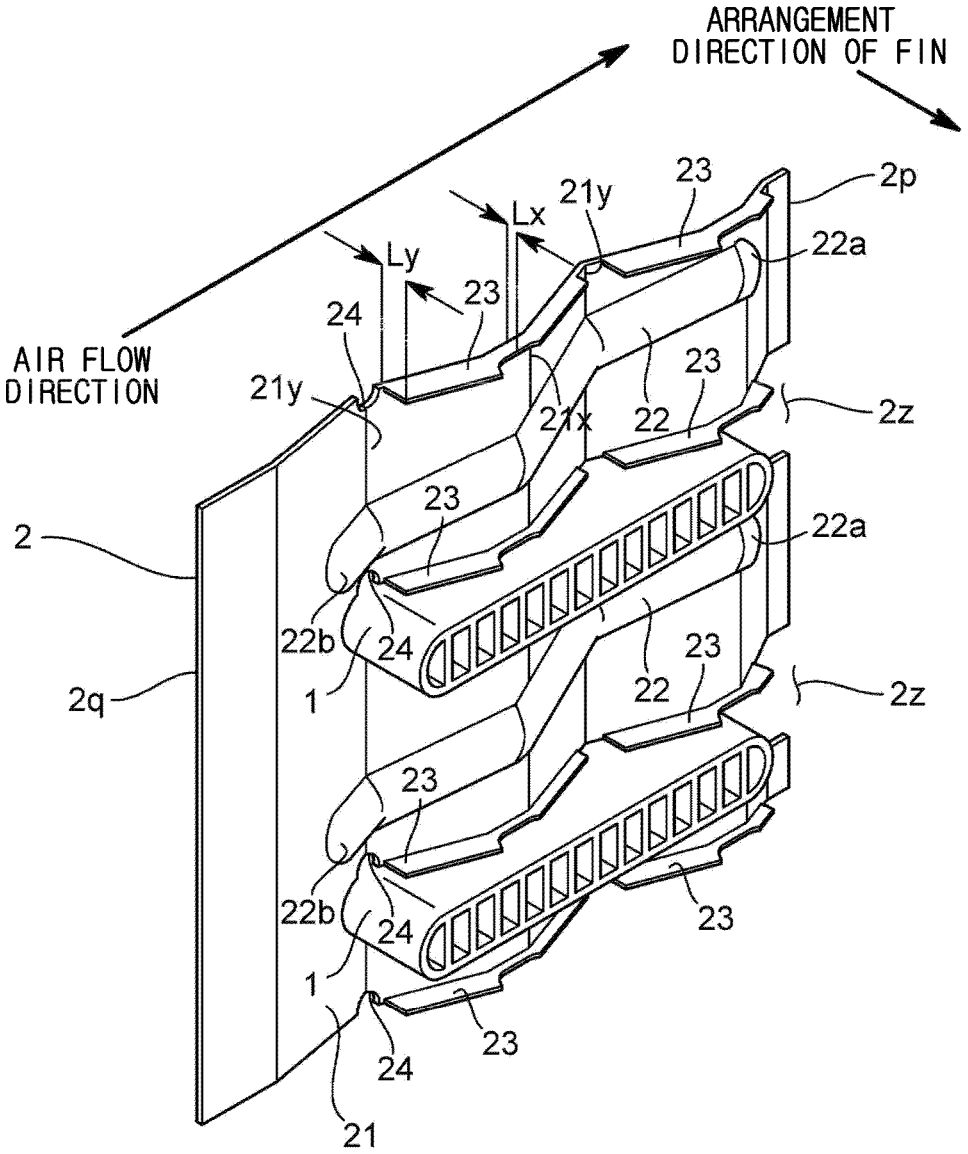
FIG. 12 is a schematic view illustrating a configuration of a fin according to an embodiment of the disclosure.

FIG. 12 is a schematic view illustrating a configuration of a fin according to an embodiment of the disclosure.

Accordingly, the fin 2 includes a stress dispersing portion 24 provided to disperse the stress at the inner end of the contact surface 23 as illustrated in FIG. 12. Particularly, the stress dispersing portion 24 is formed by cutting the peak portion 21*x* and valley portion 21*y*, which is located the innermost end among the peaks 21*x* and the valleys 21*y* overlapping in the cutting groove 2*z*, in a height direction.

Accordingly, in response to the heat transfer tube 1 is inserted into the cutting groove 2*z*, the stress applied to the inner end may be dispersed to the stress dispersing portion 24, thereby preventing damage to the fin 2.

In addition, as for the intermediate configuration illustrated in FIG. 11, in response to that the heat transfer tube 1 is inserted into the cutting groove 2*z*, a moment, which is applied to a direction in which the fin 2 is bent, may be increased and thus the fin 2 may be broken.

Therefore, referring to FIG. 12, a dimension Lx of the contact surface 23 of the peak portion 21*x* in the bending direction (an arrangement direction of the fin 2) is set to be less than a dimension Ly of the contact surface 23 of the valley portion 21*y* in the bending direction (the arrangement direction of the fin 2).

With such a configuration, because the dimension Lx in the bending direction of the peak 21*x* having the greatest moment is small, it is possible to prevent damage to the fin 2.

Second Embodiment

Next, a second embodiment of the heat exchanger according to the disclosure will be described in detail with reference to the drawings. For convenience of description, the heat transfer expansion surface and the drain structure will be omitted in a description with reference to FIGS. 13 to 15, 16A, 16B, 17A, 17B, 18A, 18B, 19A to 19C, 20A, and 20B.

In the embodiment, a distance between the heat transfer tubes 1 adjacent to each other and a distance between the fin 2 and the heat transfer tube 1 will be mainly described.

Figure 13:
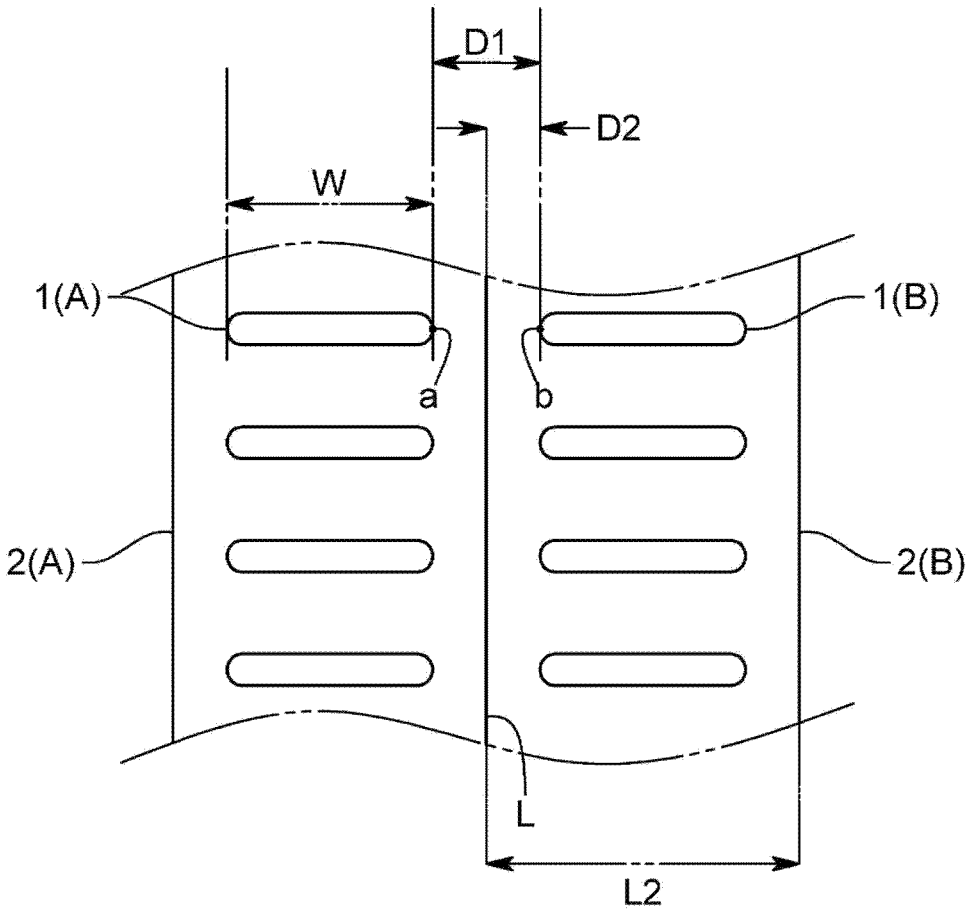
FIG. 13 is a schematic view illustrating an arrangement of heat transfer tubes and fins according to an embodiment of the disclosure.

FIG. 13 is a schematic view illustrating an arrangement of heat transfer tubes and fins according to an embodiment of the disclosure.

That is, in the embodiment, referring to FIG. 13, the distance between a first heat transfer tube 1A and a second heat transfer tube 1B adjacent to each other (hereinafter referred to as a heat transfer tube distance D1) is set to be greater than 40% of a width dimension of the first heat transfer tube 1A or the second heat transfer tube 1B (hereinafter referred to as a heat transfer tube width W).

In this case, the heat transfer tube distance D1 represents a separation distance between a width direction end (a) that is placed on the second heat transfer tube 1B side among the width direction ends of the first heat transfer tube 1A, and a width direction end (b) that is placed on the first heat transfer tube 1A side among the width direction ends of the second heat transfer tube 1B.

In addition, the heat transfer tube width W represents a separation distance between both ends of the heat transfer tube 1A and 1B in the width direction.

Figure 14:
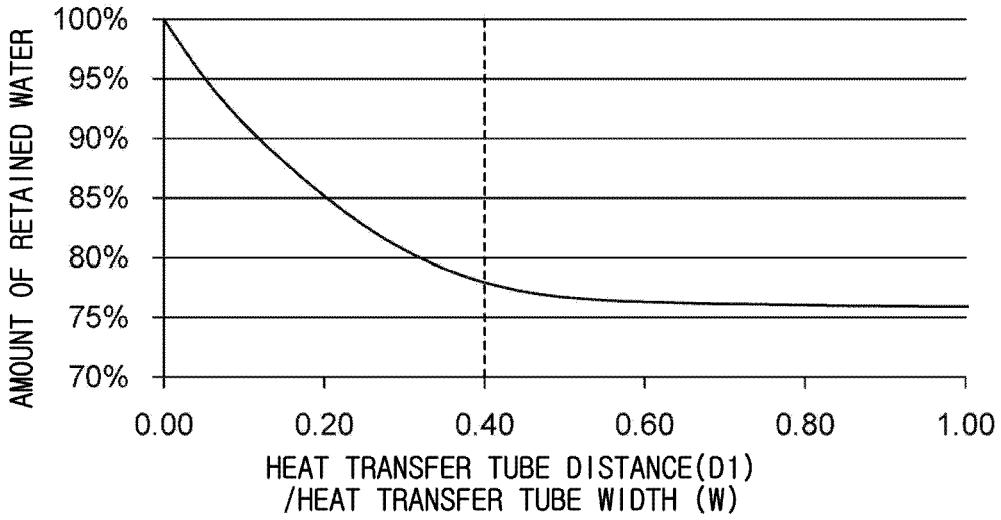
FIG. 14 is a graph illustrating a correlation between a heat transfer tube distance/a heat transfer tube width and an amount of retained water according to an embodiment of the disclosure.

FIG. 14 is a graph illustrating a correlation between a heat transfer tube distance/a heat transfer tube width and an amount of retained water according to an embodiment of the disclosure.

A graph illustrated in FIG. 14 indicates that a correlation between the heat transfer tube distance D1/the heat transfer tube width W, and an amount of retained water when it is assumed that an amount of retained water is 100% in a condition in which there is no distance between the first heat transfer tube 1A and the second heat transfer tube 1B, that is, the heat transfer tube distance D1=0.

As can be seen from the correlation, in the heat exchanger X according to the embodiment, because the heat transfer tube distance D1/the heat transfer tube width W is greater than 0.4, the amount of retained water is less than 80% of a case in which the distance between the first heat transfer tube 1A and the second heat transfer tube 1B is 0 (zero), and thus it is possible to obtain almost maximally high drainage performance.

In addition, in the embodiment, a distance from a first fin 2A to the second heat transfer tube 1B (hereinafter referred to as a fin-heat transfer tube distance D2) is set to be greater than 20% of a width dimension of the second fin 2B (hereinafter a second fin width L2), and particularly, it is appropriate that the fin-heat transfer tube distance D2 is greater than 30% of the second fin width L2.

In this case, the fin-heat transfer tube distance D2 represents a distance between a long side L, which is placed on the second heat transfer tube 1B side, of the first fin 2A, and a width direction end (b) that is placed on the first heat transfer tube 1A side among the width direction ends of the second heat transfer tube 1B.

Figure 15:
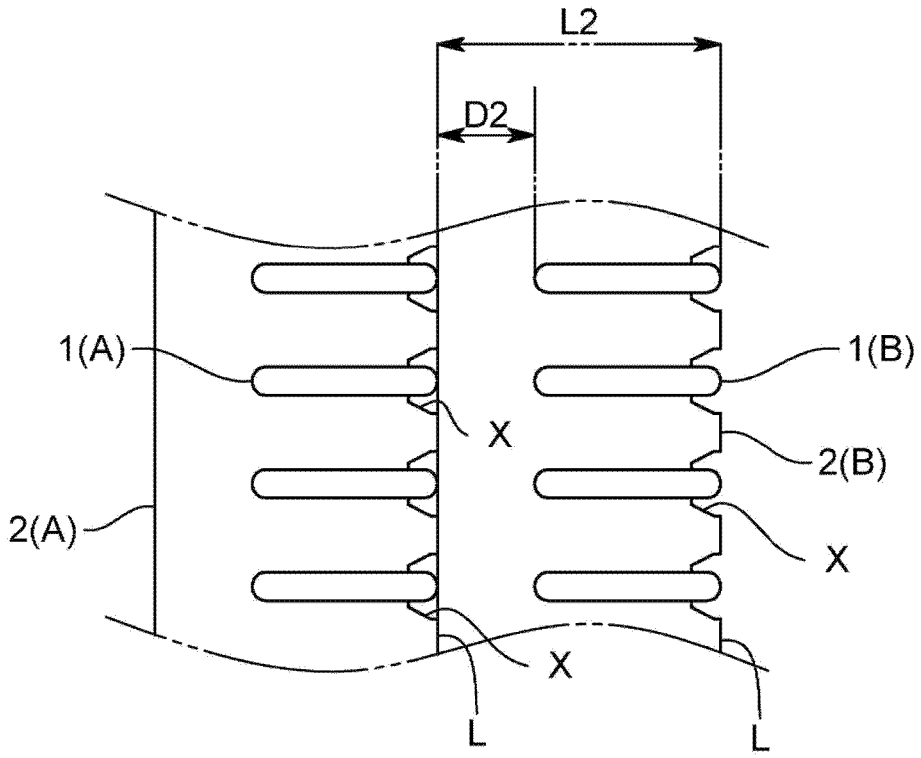
FIG. 15 is a schematic view illustrating a fin in which a cutting groove is formed according to an embodiment of the disclosure.

FIG. 15 is a schematic view illustrating a fin in which a cutting groove is formed according to an embodiment of the disclosure.

For example, referring to FIG. 15, because a cutting groove X is provided in the long side L of the first fin 2A or the second fin 2B to improve the assembly, the long side L is discontinuous due to the cutting groove X and thus the drainage is disturbed by the cutting groove X. Therefore, even when the heat transfer tube distance D1 is ensured to be large, high drainage performance may not be obtained.

According to the embodiment, because the heat transfer tube distance D1/the heat transfer tube width W is greater than 0.4, and the fin-heat transfer tube distance D2 is greater than 20% of the second fin width L2, appropriately 30% of the second fin width L2, as described above, it is possible to sufficiently secure a water supply space on the drain path.

Modification of the Second Embodiment

The disclosure is not limited to the second embodiment.

Figure 16A:
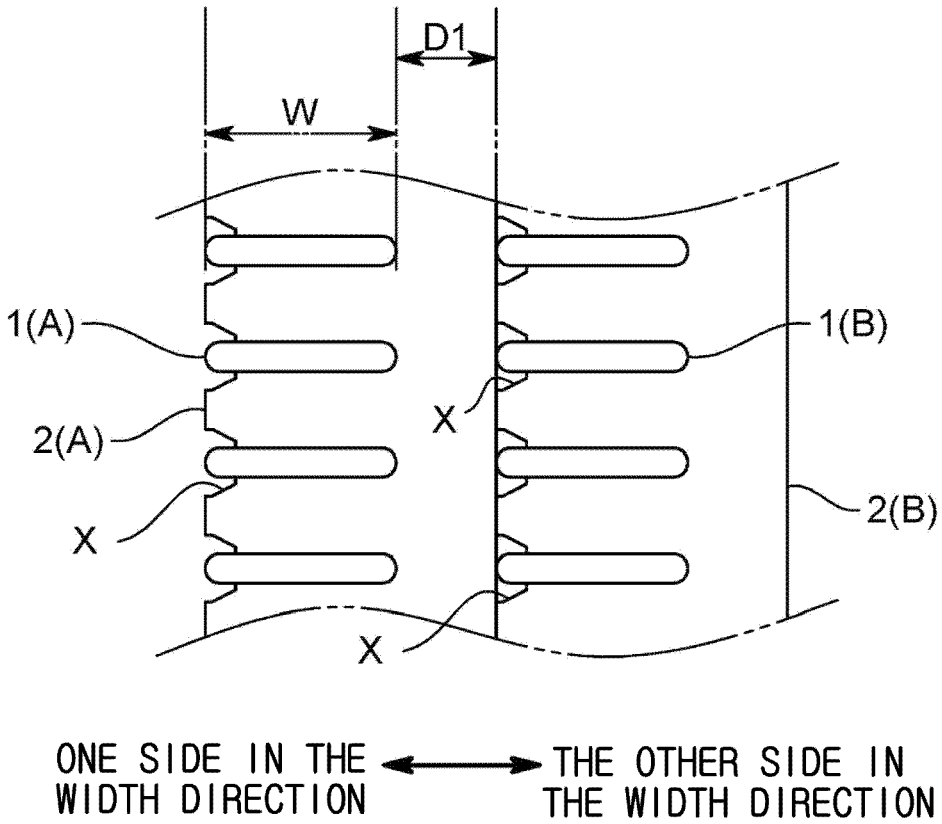
FIGS. 16A and 16B are schematic views illustrating an arrangement of heat transfer tubes and fins according to various embodiments of the disclosure.
Figure 16B:
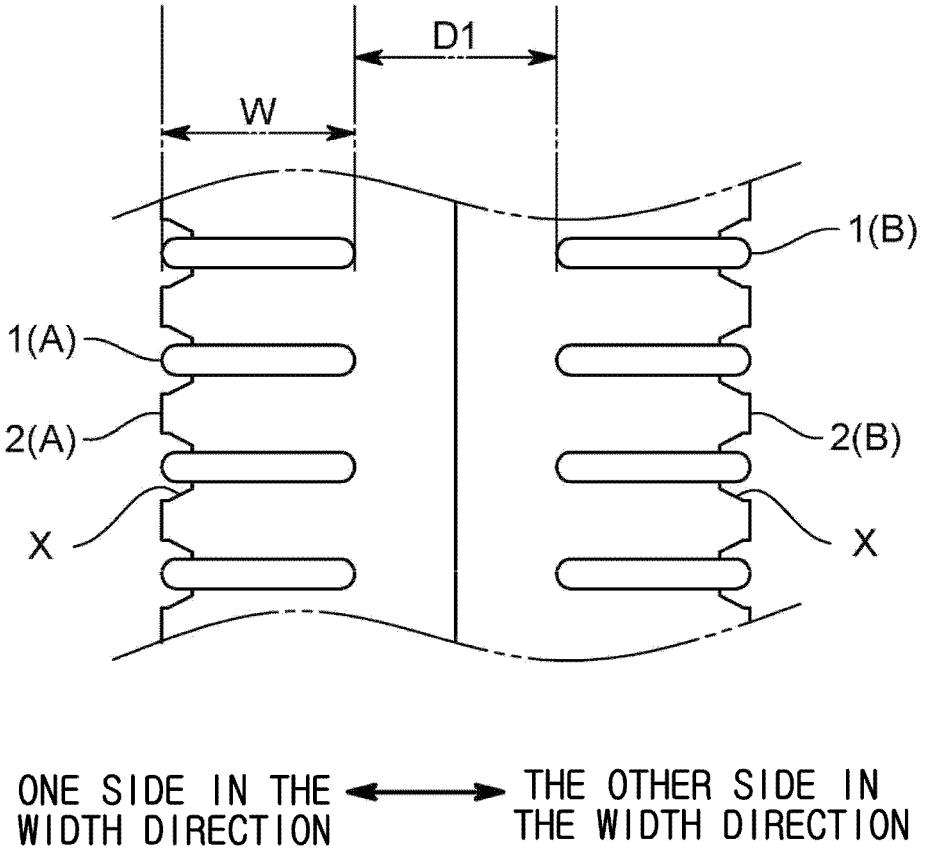

FIGS. 16A and 16B are schematic views illustrating an arrangement of heat transfer tubes and fins according to various embodiments of the disclosure.

For example, the first fin 2A or the second fin 2B may be configured illustrated in FIG. 16B.

That is, as for the first fin 2A, the cutting groove X, to which the first heat transfer tube 1A is inserted, is formed on one side of the first fin 2A in the width direction W, and the other side of the first fin 2A is continuously provided along the longitudinal direction (vertical direction).

In addition, as for the second fin 2B, one side of the second fin 2B is continuously provided along the longitudinal direction (vertical direction), and the cutting groove X, to which the second heat transfer tube 1B is inserted, is formed on the other side of the second fin 2B in the width direction.

Particularly, as for the first fin 2A, the cutting groove X is intermittently formed on the one long side along the longitudinal direction, and the other long side extends in the straight line from an upper end to a lower end.

In addition, as for the second fin 2B, the one long side extends in the straight line from an upper end to a lower end, and the cutting groove X is intermittently formed on the other long side along the longitudinal direction.

In the above configuration, referring to FIG. 16B, the first heat transfer tube 1A may be disposed on one side in the width direction rather than the center of the first fin 2A in the width direction, and at the same time, the second heat transfer tube 1B may be disposed on the other side in the width direction W rather than the center of the second fin 2B in the width direction.

Further, the other side of the first fin 2A in the width direction and the one side of the second fin 2B in the width direction may be interposed between the first heat transfer tube 1A and the second heat transfer tube 1B.

In other words, the cutting groove X of the first fin 2A and the cutting groove X of the second fin 2B are formed to face in opposite directions, and the long side extending in the straight line from the upper end to the lower end of the first fin 2A and the long side extending in the straight line from the upper end to the lower end of the second fin 2B may be provided adjacent to each other.

With such a configuration, because the heat transfer tube distance D1 is increased in comparison with the configuration illustrated in FIG. 16A, it is possible to move the condensed water to between the first heat transfer tube 1A and the second heat transfer tube 1B. Further, the heat exchanger 100 according to the disclosure may include the configuration illustrated in FIG. 16A.

Figure 17A:
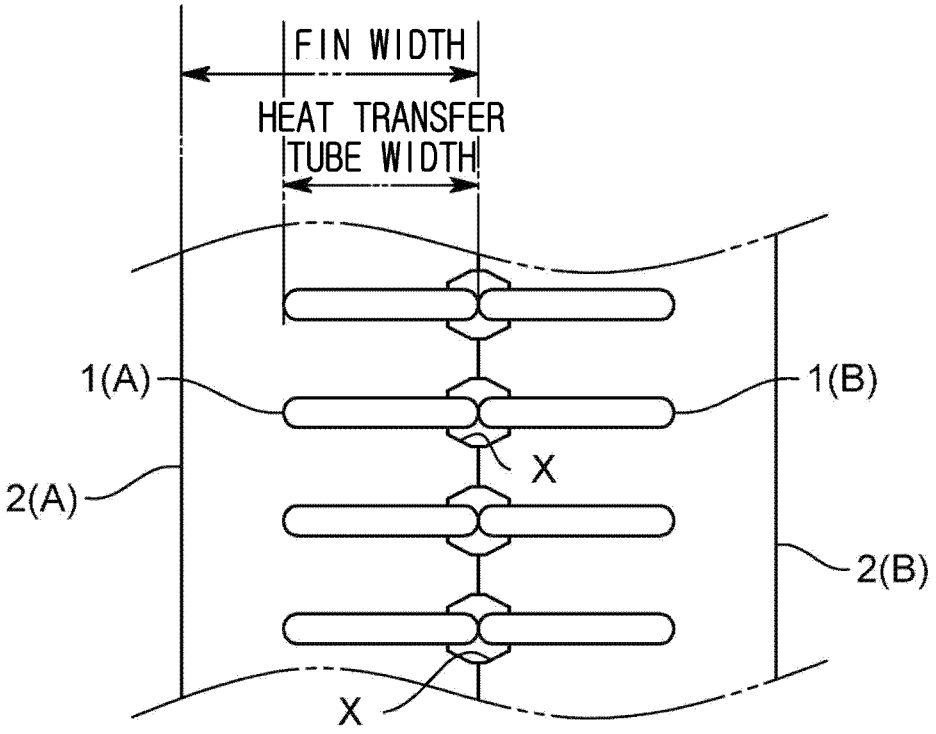
FIGS. 17A and 17B are schematic views illustrating an arrangement of heat transfer tubes and fins according to various embodiments of the disclosure.
Figure 17B:
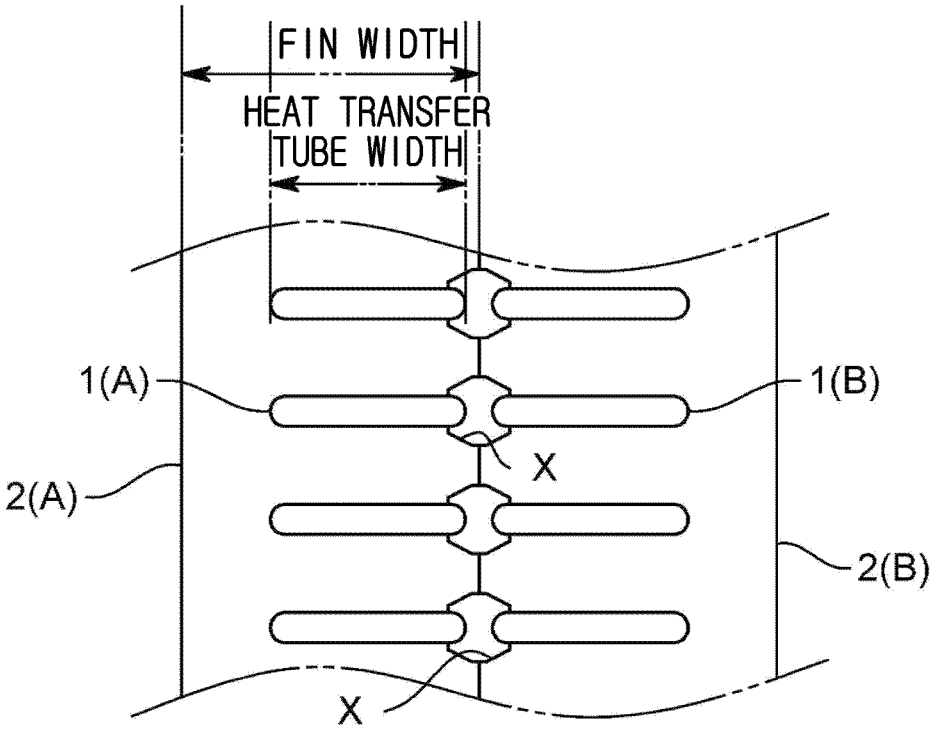

FIGS. 17A and 17B are schematic views illustrating an arrangement of heat transfer tubes and fins according to various embodiments of the disclosure.

Referring to FIG. 17B, an arrangement of the first heat transfer tube 1A in the first fin 2A may be provided in such a way that both ends of the first heat transfer tube 1A in the width direction are positioned inward than both ends of the first fin 2A in the width direction, and an arrangement of the second heat transfer tube 1B in the second fin 2B may be provided in such a way that both ends of the second heat transfer tube 1B in the width direction are positioned inward than both ends of the second fin 2B in the width direction. In addition, the cutting groove X formed in the first fin 2A may be formed to face the cutting groove X of the second fin 2B.

With such a configuration, because the heat transfer tube distance D1 is increased in comparison with the configuration referring to FIG. 17A, it is possible to move the condensed water to between the first heat transfer tube 1A and the second heat transfer tube 1B. Further, the heat exchanger 100 according to the disclosure may include the configuration referring to FIG. 17A.

Figure 18A:
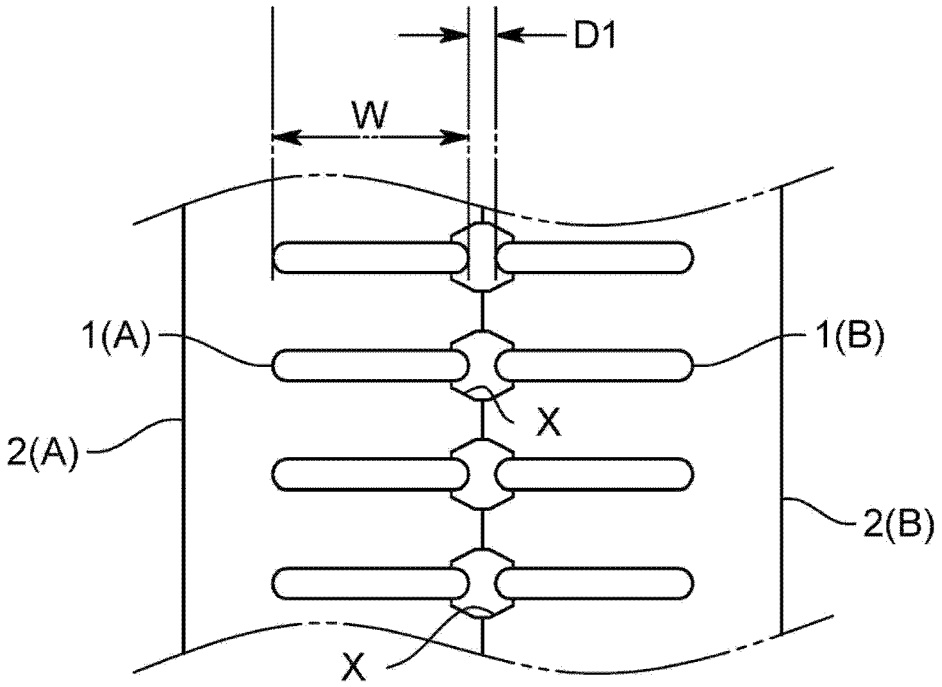
FIGS. 18A and 18B are schematic views illustrating an arrangement of heat transfer tubes and fins according to various embodiments of the disclosure.
Figure 18B:
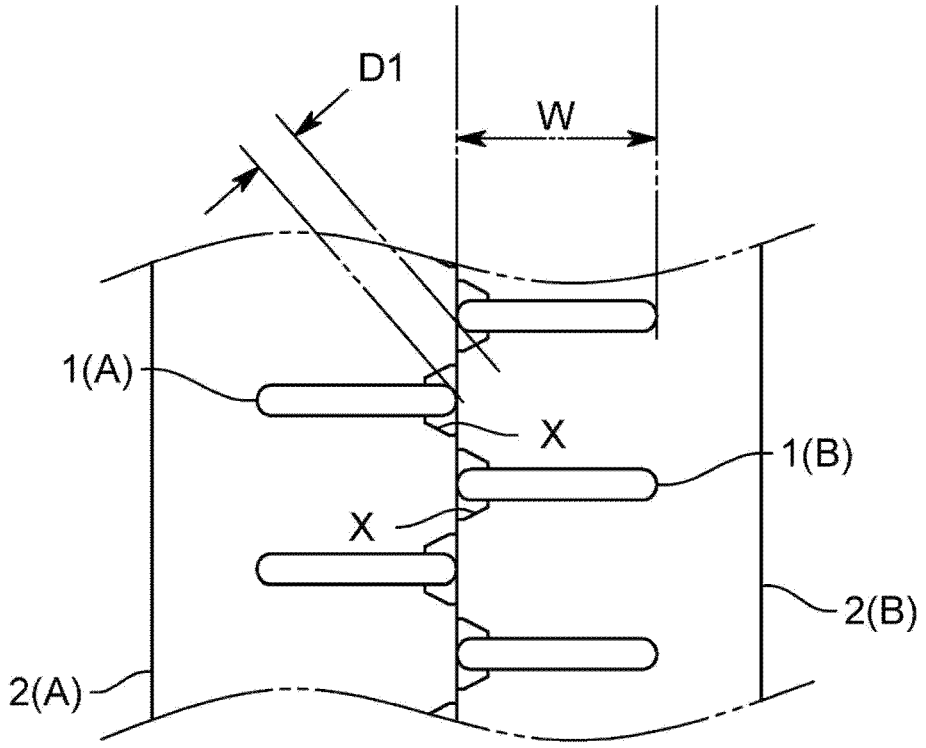

FIGS. 18A and 18B are schematic views illustrating an arrangement of heat transfer tubes and fins according to various embodiments of the disclosure.

The first heat transfer tube 1A and the second heat transfer tube 1B adjacent to each other are arranged to have the same height as each other in the above embodiment, but the first heat transfer tube 1A and the second heat transfer tube 1B may be arranged at different heights. For example, the first heat transfer tube 1A and the second heat transfer tube 1B may be arranged in a zigzag shape along the longitudinal direction perpendicular to the width direction W, as illustrated in FIG. 18B.

In this case, the heat transfer tube distance D1 may represent a separation distance between a width direction end that is placed on the second heat transfer tube 1B side among the width direction ends of the first heat transfer tube 1A, and a width direction end that is placed on the first heat transfer tube 1A side among the width direction ends of the second heat transfer tube 1B.

With such a configuration, because the heat transfer tube distance D1 is increased in comparison with the configuration illustrated in FIG. 18A, it is possible to move the condensed water to between the first heat transfer tube 1A and the second heat transfer tube 1B. Further, the heat exchanger 100 according to the disclosure may include the configuration referring to FIG. 18A.

In the above embodiment, in the first fin 2A and the second fin 2B, one row of first heat transfer tubes 1A arranged in multiple stages or one row of the second heat transfer tubes 1B arranged in multiple stages is provided. However, in the fin 2A and/or the second fin 2B, the first heat transfer tube 1A or the second heat transfer tube 1B may be provided in a plurality of rows, respectively. That is, in the one row of the fin 2A (or 2B), two row of heat transfer tube 1A and 1B may be provided.

Figure 19A:
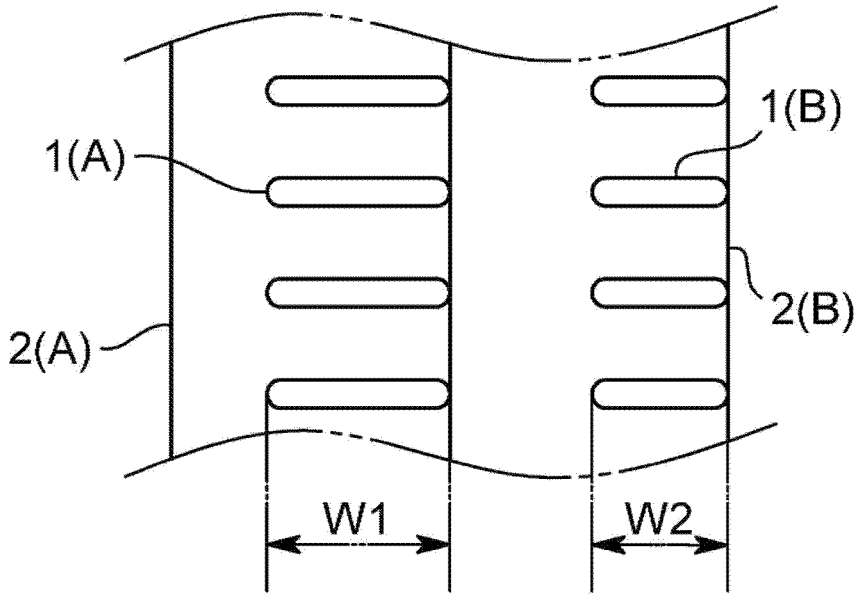
FIGS. 19A, 19B, and 19C are schematic views illustrating an arrangement of heat transfer tubes and fins according to various embodiments of the disclosure.
Figure 19B:
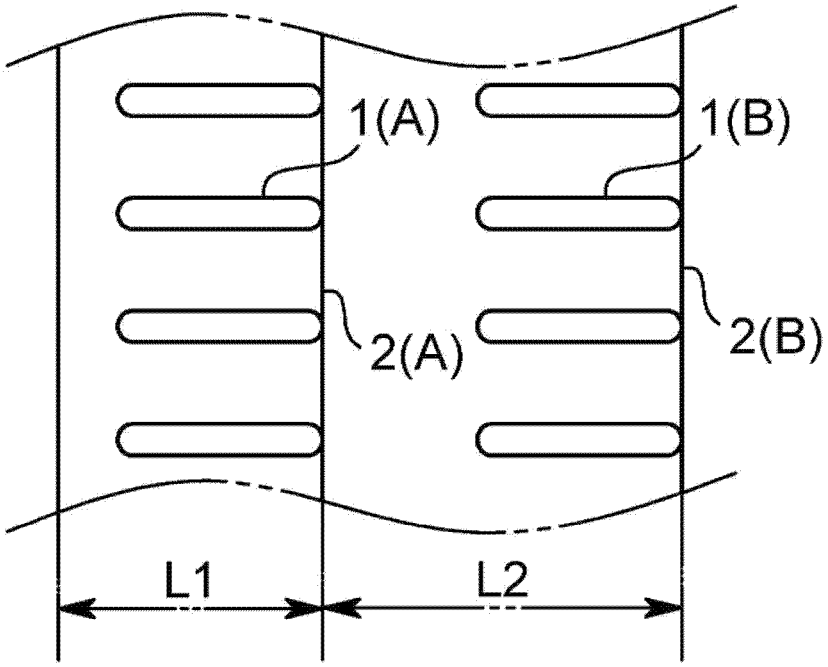
Figure 19C:
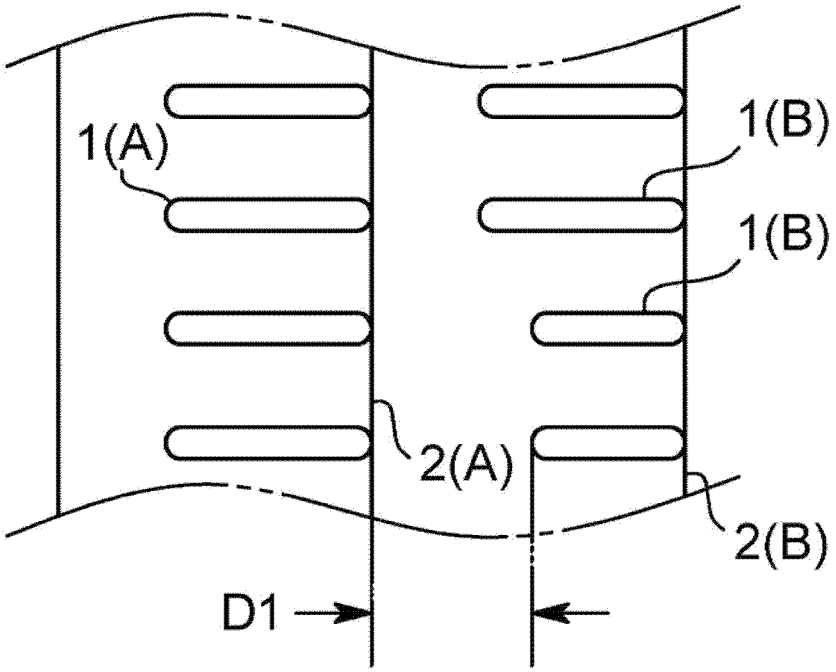

FIGS. 19A, 19B, and 19C are schematic views illustrating an arrangement of heat transfer tubes and fins according to various embodiments of the disclosure.

The first heat transfer tube 1A and the second heat transfer tube 1B may have different width dimensions W1 and W2 as illustrated in FIG. 19A.

In addition, the first fin 2A and the second fin 2B may have different width dimensions L1 and L2 as illustrated in FIG. 19B.

In addition, as illustrated in FIG. 19C, the heat transfer tube distance D1 in a portion in which a large amount of condensed water is retained, may be set to be greater than a heat transfer tube distance in a portion in which a small amount of condensed water is retained.

Further, the case, in which the cutting groove X provided on the long side L of the first fin 2A or the second fin 2B causes the decrease in the drainage performance, is the same as the description of FIG. 15.

Figure 20A:
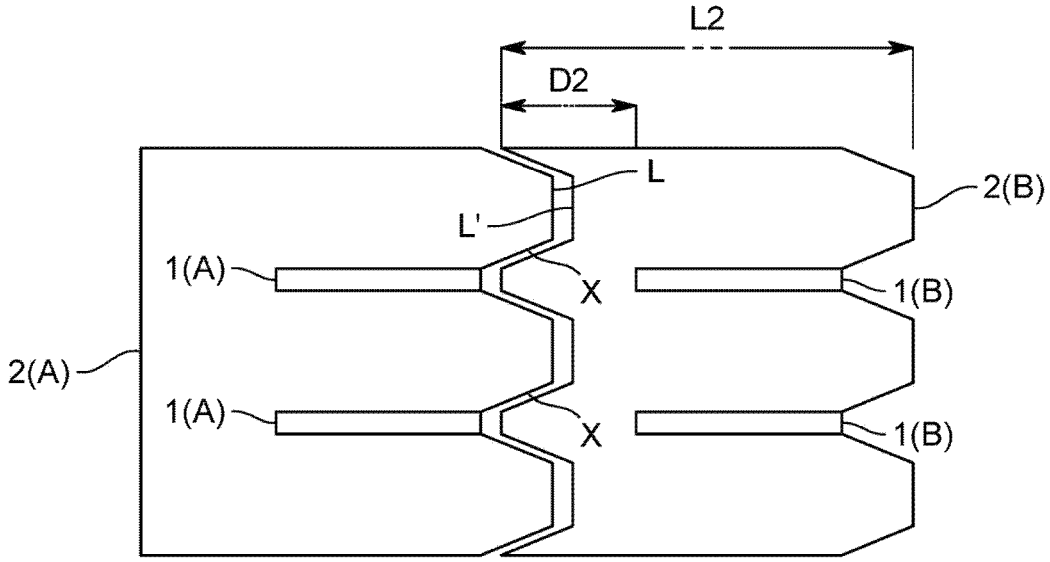
FIGS. 20A and 20B are schematic views illustrating an arrangement of heat transfer tubes and fins according to various embodiments of the disclosure.
Figure 20B:
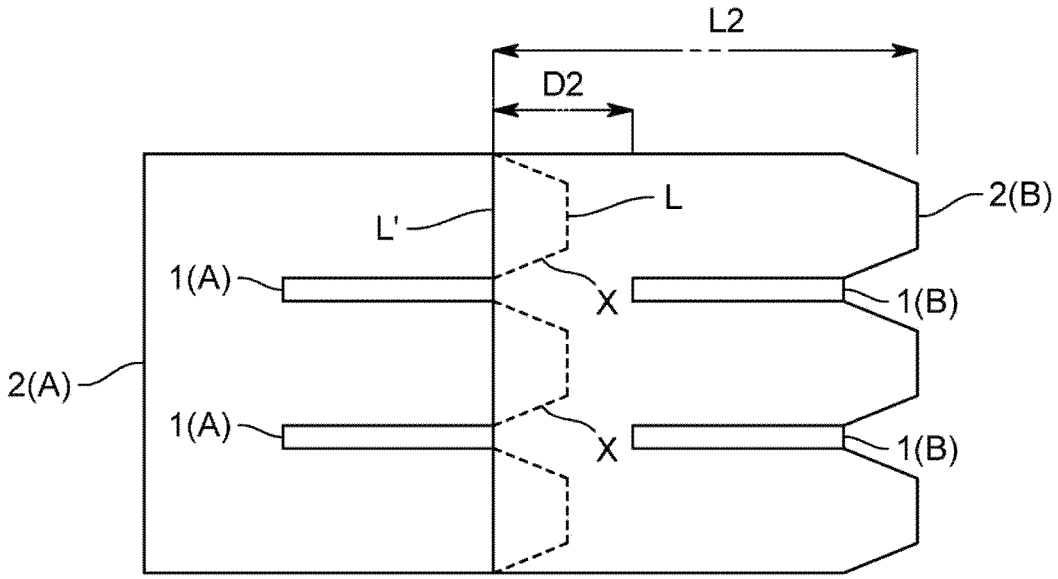

FIGS. 20A and 20B are schematic views illustrating an arrangement of heat transfer tubes and fins according to various embodiments of the disclosure.

Referring to FIG. 20A, the cutting groove X may be provided on the long side L of the first fin 2A, and at the same time, a long side L' of the second fin 2B that is adjacent to the cutting groove X may have a shape corresponding to the cutting groove X.

Referring to FIG. 20B, the cutting groove X may be provided on the long side L of the first fin 2A, and at the same time, a long side L' of the second fin 2B that is adjacent to the cutting groove X may be arranged to overlap the cutting groove X.

With such a configuration, it is possible to expand the drain path in the discontinuous portion generated by the cutting groove X, thereby improving the drainage performance.

Third Embodiment

Next, a third embodiment of the heat exchanger according to the disclosure will be described in detail with reference to the drawings. For convenience of description, the heat transfer expansion surface and the drain structure will be omitted in a description with reference to FIGS. 21 to 26.

In the embodiment, a relationship between a width dimension of the heat transfer tube, and a fin pitch will be mainly described.

Fins 2 according the embodiment are arranged at a predetermined fin pitch along an extending direction of the heat transfer tube 1, and are arranged at regular intervals.

Figure 21:
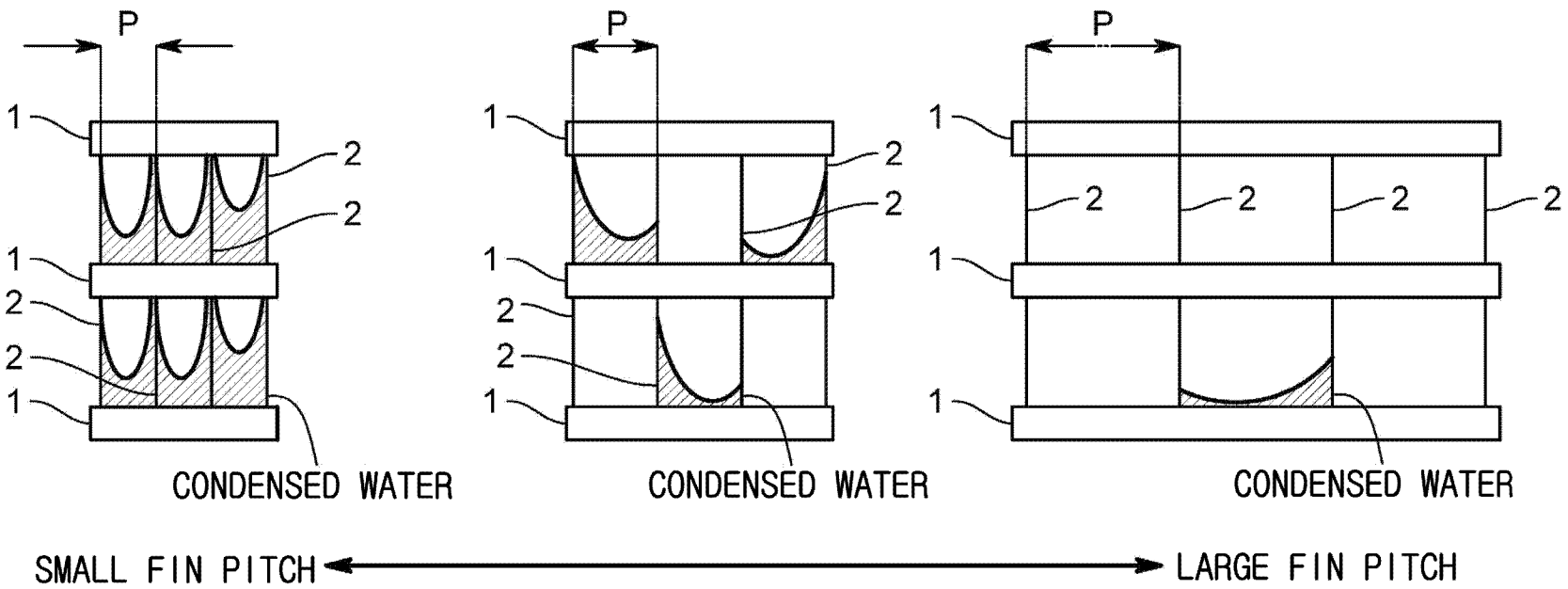
FIG. 21 is a schematic view illustrating a correlation between a fin pitch and an amount of condensed water according to an embodiment of the disclosure.

FIG. 21 is a schematic view illustrating a correlation between a fin pitch and an amount of condensed water according to an embodiment of the disclosure.

In the configuration, in which the flat heat transfer tube 1 passes through the plurality of fins 2, referring to FIG. 21, in response to that a fin pitch P of the plurality of fins 2 is too small, a bridge of condensed water may be easily formed between the fins 2, and thus it is difficult to obtain the sufficient drainage performance. However, in response to that the fin pitch P of the plurality of fins 2 is too large, it is difficult to secure the heat exchange efficiency.

In this case, the fin pitch P represents a separation distance between the fins adjacent to each other along the extending direction with respect to the extending direction of the heat transfer tube 1.

Figure 22:
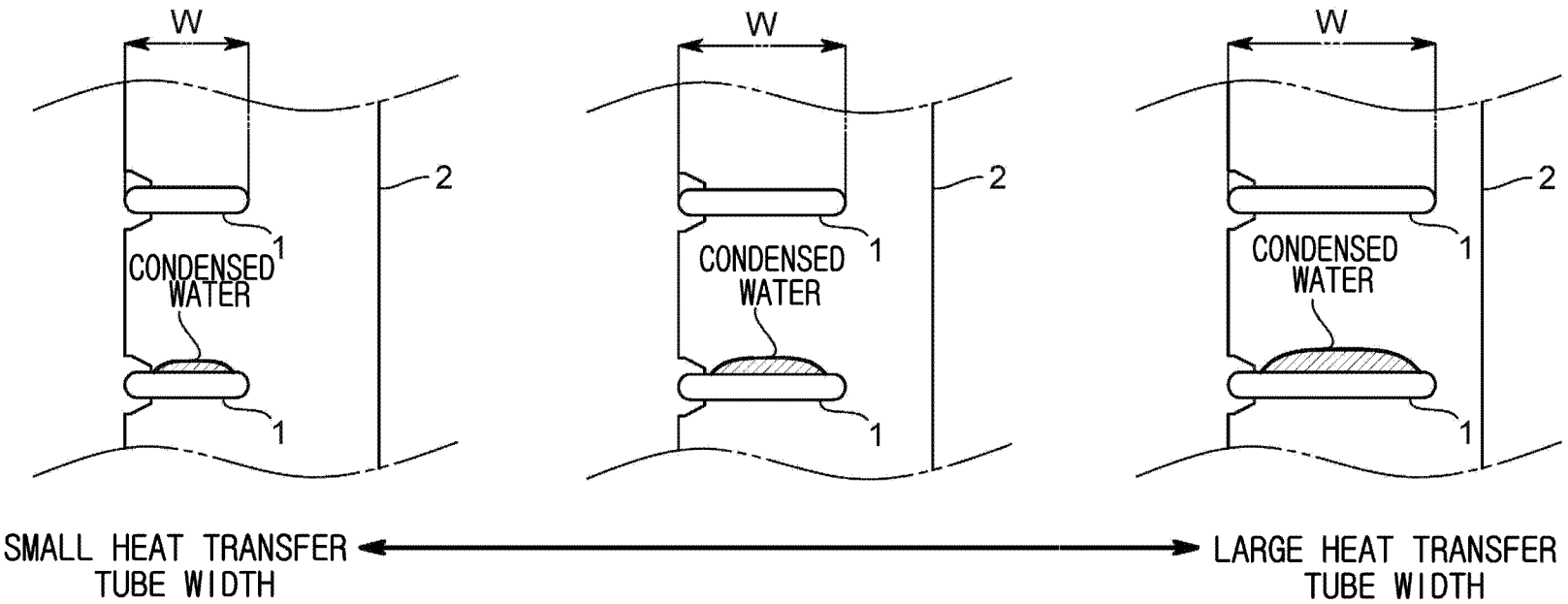
FIG. 22 is a schematic view illustrating a correlation between a heat transfer tube width and an amount of condensed water according to an embodiment of the disclosure.

FIG. 22 is a schematic view illustrating a correlation between a heat transfer tube width and an amount of condensed water according to an embodiment of the disclosure.

Referring to FIG. 22, in response to that a width dimension W of the heat transfer tube 1 (hereinafter referred to as a heat transfer tube width W) is too large, an amount of condensed water retained on the heat transfer tube 1 increases, and thus it is difficult to obtain the sufficient drainage performance. However, in response to that the heat transfer tube width W is too small, it is difficult to secure the heat exchange efficiency.

In this case, the heat transfer tube width W represents a separation distance from one end of the heat transfer tube 1 in the width direction to the other end of the heat transfer tube 1 in the width direction.

Therefore, it is appropriate that the heat transfer tube width W is greater than or equal to 4 times, but is less than or equal to 7 times of the fin pitch P.

Particularly, according to the embodiment, the heat transfer tube width W of at least one portion of the heat transfer tube is less than or equal to 10 mm, particularly, less than or equal to 10 mm along the longitudinal direction.

Figure 23:
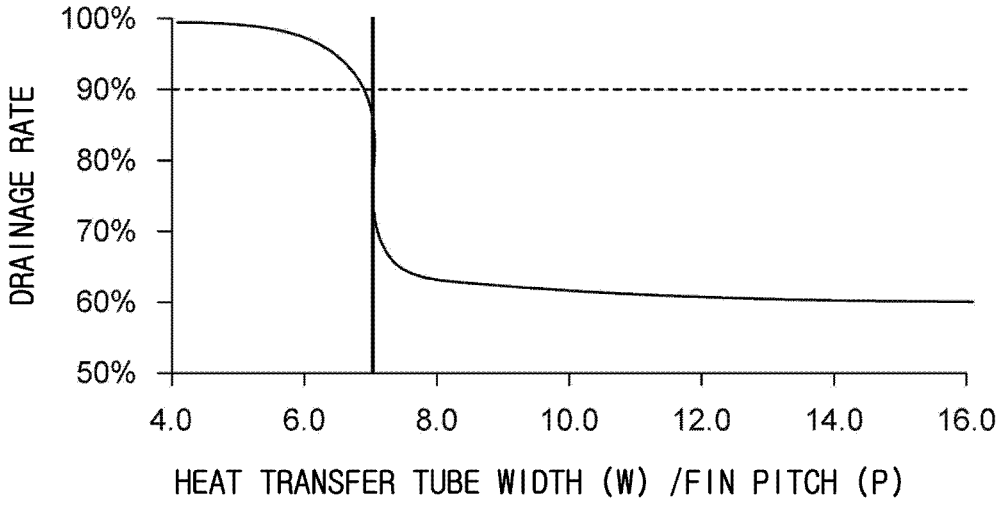
FIG. 23 is a graph illustrating a correlation between a heat transfer tube width/a fin pitch and a drainage rate according to an embodiment of the disclosure.

FIG. 23 is a graph illustrating a correlation between a heat transfer tube width/a fin pitch and a drainage rate according to an embodiment of the disclosure.

A graph illustrated in FIG. 23 indicates a correlation between the heat transfer tube width W/fin pitch P and the drainage performance. As can be seen from FIG. 23, it is difficult to expect the improvement in the drainage performance even when the heat transfer tube width W/fin pitch P is less than 4.0, and thus it is assumed that a drainage performance of a surface of the heat transfer tube is 100% in a condition in which the heat transfer tube width W/fin pitch P is 4.0.

As can be seen from the correlation, in the heat exchanger 100 according the embodiment, because the heat transfer tube width W/fin pitch P is greater than or equal to 4, it is possible to secure the heat exchange efficiency, and further the heat transfer tube width W/fin pitch P is less than or equal to 7, it is possible to reduce the deterioration of the drainage rate by about 10%.

In addition, the disclosure is not limited to the third embodiment.

Figure 24:
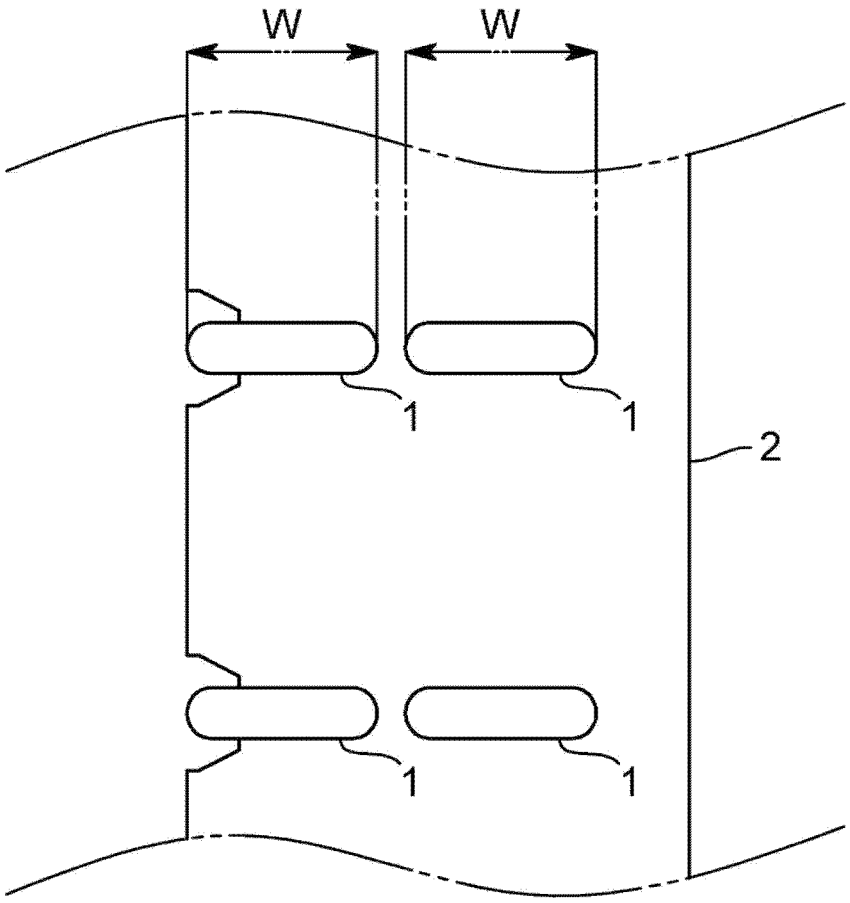
FIG. 24 is a schematic view illustrating a configuration of a heat transfer tube according to an embodiment of the disclosure.

FIG. 24 is a schematic view illustrating a configuration of a heat transfer tube according to an embodiment of the disclosure.

For example, in the above embodiment, one row of heat transfer tubes 1 is provided for one row of fins 2, but referring to FIG. 24, two or more rows of heat transfer tubes 1 arranged in the width direction may be provided with an interval for one row of fins 2. FIG. 24 illustrates that a pair of the heat transfer tubes 1 arranged in the width direction have the same width dimension W, but the heat transfer tubes may have different width dimensions.

With such a configuration, because two or more rows of heat transfer tubes 1 are provided, it is possible to obtain substantially the same heat exchange efficiency as a case in which one row of a heat transfer tube having a width dimension corresponding to a sum of a width dimension of two or more row of the heat transfer tubes is provided. Further, it is possible to reduce the heat transfer tube width of each row, and thus it is possible to reduce the amount of condensed water retained on the surface of the heat transfer tube 1.

Figure 25:
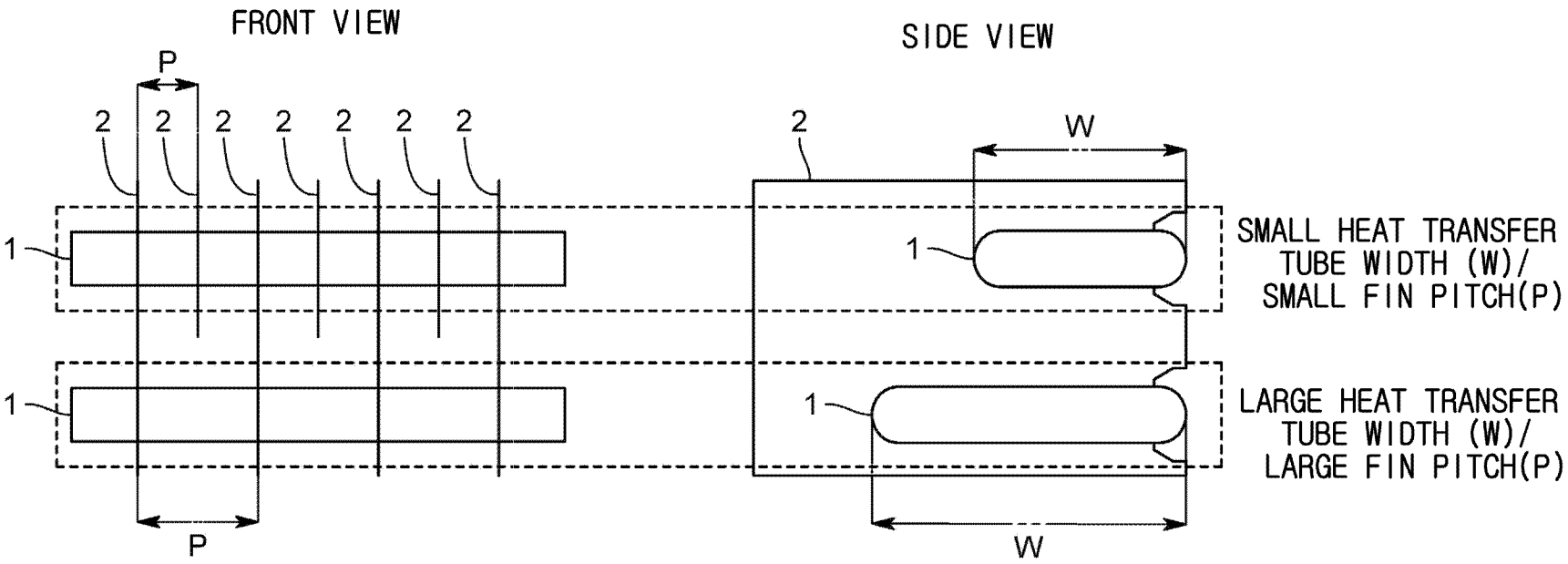
FIG. 25 is a schematic view illustrating a configuration of a heat transfer tube and a fin according to an embodiment of the disclosure.

FIG. 25 is a schematic view illustrating a configuration of a heat transfer tube and a fin according to an embodiment of the disclosure.

Further, as the heat exchanger 100, the heat transfer tube width W/fin pitch P may be configured differently on each stage of the heat transfer tube 1, as illustrated in FIG. 25.

As described above, by changing the heat transfer tube width W according to the size of the pitch P between fins 2, it is possible to obtain equalization of drainage performance.

Figure 26:
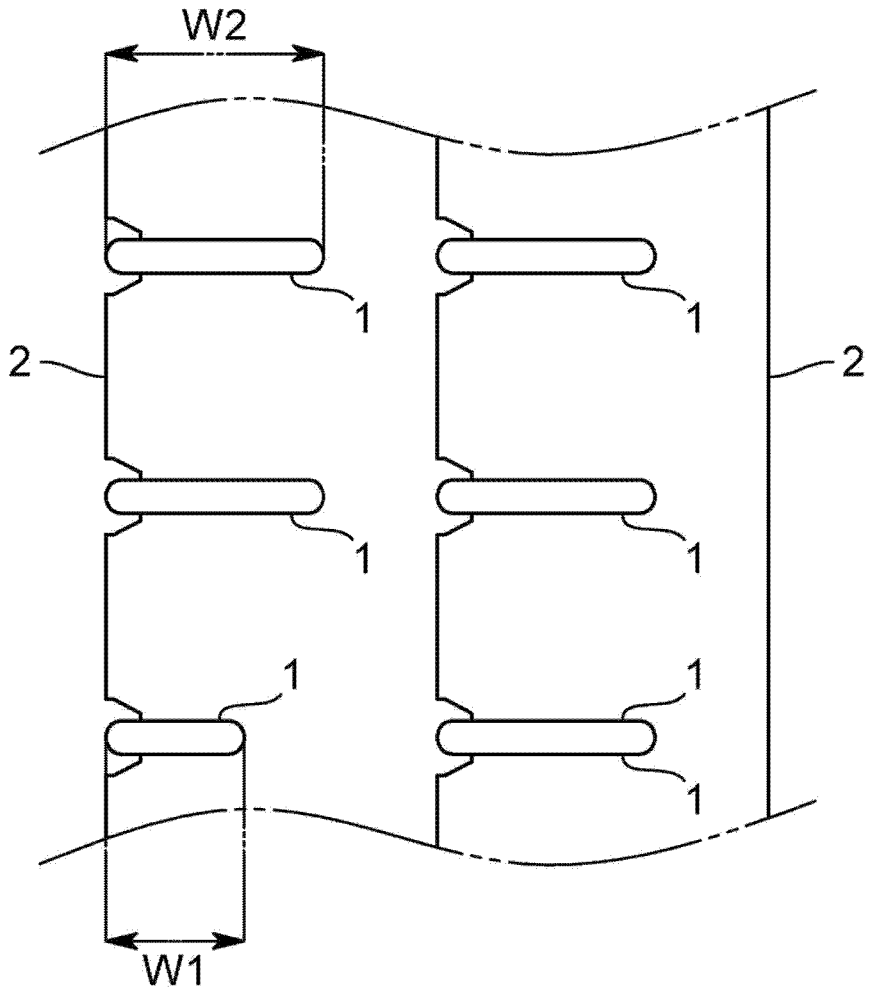
FIG. 26 is a schematic view illustrating a configuration of a heat transfer tube and a fin according to an embodiment of the disclosure.

FIG. 26 is a schematic view illustrating a configuration of a heat transfer tube and a fin according to an embodiment of the disclosure.

Referring to FIG. 26, a heat transfer tube width W1 in a portion where a large amount of condensed water is retained may be less than a heat transfer tube width W2 in a portion where a small amount of condensed water is retained.

As is apparent from the above description, as for a heat exchanger including a configuration, in which a heat transfer tube having a flat shape passes through a plurality of fins, it is possible to secure drainage performance of condensed water retained on a surface of the heat transfer tube while improving a heat transfer rate, and further it is possible to suppress an increase in ventilation resistance.

While the disclosure has been shown and described with reference to various embodiments thereof, it will be understood by those skilled in the art that various changes in form and details may be made therein without departing from the spirit and scope of the disclosure as defined in by the appended claims and their equivalents.

What is claimed is:

1. A heat exchanger comprising:

a heat transfer tube formed in a flat shape; and a plurality of fins, wherein a refrigerant flowing inside the heat transfer tube exchanges heat with air flowing between the plurality of fins, wherein each fin of the plurality of fins comprises:

a heat transfer expansion surface comprising a plurality of peak portions and a plurality of valley portions provided along an air flow direction, and a drain structure provided to overlap each of the plurality of peak portions and the plurality of valley portions of the heat transfer expansion surface, and wherein the drain structure includes a convex portion formed on the heat transfer expansion surface, wherein the heat transfer tube includes a plurality of heat transfer tubes arranged in multiple stages in a vertical direction, wherein each heat transfer tube has a flat surface facing in an upward direction and a flat surface facing in a downward direction, wherein each fin is formed in a long shape extending in the vertical direction, wherein the plurality of heat transfer tubes passes through at least one of the plurality of fins, wherein a cutting groove is formed at a position corresponding to the plurality of heat transfer tubes in a first long side of each fin, wherein a second long side of each fin extends in a straight line from an upper end to a lower end, and wherein the drain structure is provided to drain water droplets toward the second long side of the fin.

2. The heat exchanger of claim 1, wherein the drain structure is a bead formed on the heat transfer expansion surface.

3. The heat exchanger of claim 1, wherein a height of a first portion of the drain structure is less than a height of a second portion of the drain structure, and wherein the first portion of the drain structure overlaps a peak portion of the plurality of peak portions of the heat transfer expansion surface and the second portion of the drain structure overlaps a valley portion of the plurality of valley portions of the heat transfer expansion surface.

4. The heat exchanger of claim 1, wherein each fin is a corrugated fin in which a peak portion of the plurality of peak portions and a valley portion of the plurality of valley portions are alternately formed, and a corrugated angle between the peak portion of the plurality of peak portions and the valley portion of the plurality of valley portions is greater than or equal to 5° and less than or equal to 24°.

5. The heat exchanger of claim 1, wherein the heat transfer tube includes a plurality of first heat transfer tubes and a plurality of second heat transfer tubes, wherein the plurality of first heat transfer tubes passes through a first fin of the plurality of fins and the plurality of second heat transfer tubes passes through a second fin of the plurality of fins, wherein a distance between one of the first heat transfer tubes and one of the second heat transfer tubes adjacent to each other is greater than 40% of a width dimension of one of the plurality of first heat transfer tubes or one of the plurality of second heat transfer tubes, and wherein a distance between the first fin of the plurality of fins and the one of the second heat transfer tubes is greater than 20% of a width dimension of the second fin.

6. An air conditioner comprising:

a heat exchanger comprising a heat transfer tube formed in a flat shape and a plurality of fins, the heat exchanger configured to allow a refrigerant flowing inside the heat transfer tube to exchange heat with air flowing between the plurality of fins, wherein each fin of the plurality of fins comprises:

a heat transfer expansion surface comprising a plurality of peak portions and a plurality of valley portions provided along an air flow direction, and a drain structure provided to overlap each of the plurality of peak portions and the plurality of valley portions of the heat transfer expansion surface, and wherein the drain structure includes a convex portion formed in the heat transfer expansion surface, wherein the heat transfer tube includes a plurality of heat transfer tubes arranged in multiple stages in a vertical direction, wherein each heat transfer tube has a flat surface facing in an upward direction and a flat surface facing in a downward direction, wherein each fin is formed in a long shape extending in the vertical direction, wherein the plurality of heat transfer tubes passes through at least one of the plurality of fins, wherein a cutting groove is formed at a position corresponding to the plurality of heat transfer tubes in a first long side of each fin, wherein a second long side of each fin extends in a straight line from an upper end to a lower end, and wherein the drain structure is provided to drain water droplets toward the second long side of the fin.

7. The air conditioner of claim 6, wherein a height of a first portion of the drain structure is less than a height of a second portion of the drain structure, and wherein the first portion of the drain structure overlaps a peak portion of the plurality of peak portions of the heat transfer expansion surface and the second portion of the drain structure overlaps a valley portion of the plurality of valley portions of the heat transfer expansion surface.

8. The air conditioner of claim 6, wherein the heat transfer tube includes a plurality of first heat transfer tubes and a plurality of second heat transfer tubes, wherein the plurality of first heat transfer tubes passes through a first fin of the plurality of fins and the plurality of second heat transfer tubes passes through a second fin of the plurality of fins, wherein a distance between one of the first heat transfer tubes and one of the second heat transfer tubes adjacent to each other is greater than 40% of a width dimension of one of the plurality of first heat transfer tubes or one of the plurality of second heat transfer tubes, and wherein a distance between the first fin of the plurality of fins and the one of the second heat transfer tubes is greater than 20% of a width dimension of the second fin.

9. The air conditioner of claim 6, wherein the drain structure is a bead formed on the heat transfer expansion surface.

10. The air conditioner of claim 6, wherein the drain structure is positioned on an incline such that a first end of the drain structure is higher than a second end of the drain structure, and wherein the first end of the drain structure is located toward the first long side of each fin and the second end of the drain structure is located toward the second long side of each fin.

11. The air conditioner of claim 8, wherein the plurality of first heat transfer tubes are aligned with respect to a first side of the first fin, and wherein the plurality of second heat transfer tubes are aligned with respect to a first side of the second fin.

12. The air conditioner of claim 11, wherein a plurality of cutting grooves is formed in the first side of the first fin such that each of the plurality of first heat transfer tubes correspond to one of the plurality of cutting grooves formed in the first side of the first fin, wherein a plurality of cutting grooves is formed in the first side of the second fin such that each of the plurality of second heat transfer tubes correspond to one of the plurality of cutting grooves formed in the first side of the second fin, and wherein the plurality of cutting grooves formed in the first side of the first fin and the plurality of cutting grooves formed in the first side of the second fin are disposed in a longitudinal direction.

13. The air conditioner of claim 8, wherein the plurality of first heat transfer tubes is positioned away from a first end and a second end of the first fin, and wherein the plurality of second heat transfer tubes is positioned away from the first end and a second end of the second fin.

14. The air conditioner of claim 8, wherein the each of the first heat transfer tubes and each of the second heat transfer tubes are arranged such that a zigzag shape is created along a longitudinal direction.

15. The air conditioner of claim 8, wherein the plurality of first heat transfer tubes is provided in a plurality of rows with respect to the first fin, and wherein the plurality of second heat transfer tubes is provided in a plurality of rows with respect to the second fin.

16. The air conditioner of claim 6, wherein the heat transfer tube passes through the plurality of fins, wherein the plurality of fins is arranged at a predetermined fin pitch, and wherein a width dimension of the heat transfer tube is greater than or equal to 4 times and is less than or equal to 7 times of the fin pitch.

17. The air conditioner of claim 16, wherein a width dimension of at least a portion of the heat transfer tube is less than or equal to 10 mm.

18. The air conditioner of claim 6, wherein each fin is a corrugated fin in which a peak portion of the plurality of peak portions and a valley portion of the plurality of valley portions are alternately formed, and a corrugated angle between the peak portion of the plurality of peak portions and the valley portion of the plurality of valley portions is greater than or equal to 5° and less than or equal to 24°.

* * * * *